United States Patent [19]

Claycomb

[11] 4,235,021

[45] Nov. 25, 1980

[54] MEASURING WHILE DRILLING TOOL

[75] Inventor: Jack R. Claycomb, Houston, Tex.

[73] Assignee: Dresser Industries, Inc., Dallas, Tex.

[21] Appl. No.: 887,225

[22] Filed: Mar. 16, 1978

[51] Int. Cl.[3] ..... E21B 47/022

[52] U.S. Cl. ..... 33/307; 73/37

[58] Field of Search ..... 33/306, 307, 308, 302, 33/301; 73/37

[56] References Cited

U.S. PATENT DOCUMENTS

| | | | |
|---|---|---|---|
| 3,466,755 | 9/1969 | Alder | 33/307 |
| 3,468,035 | 9/1969 | Taylor, Jr. | 33/307 |
| 3,983,948 | 10/1976 | Jeter | 33/306 |

*Primary Examiner*—William D. Martin, Jr.

*Attorney, Agent, or Firm*—Gunn, Lee & Jackson

[57] ABSTRACT

A measuring while drilling tool is disclosed. The preferred embodiment incorporates an outer shell which is connected in a drill string above the drill bit and among the drill collars. The apparatus utilizes mud pressure variations to pump oil with a piston to energize a closed hydraulic circuit. The oil is delivered via a distribution and manifold system to first fill and scan five hydraulic signals sequentially. The sequential scan of the five hydraulic signals is then conveyed to an output mechanism comprising a choke which is placed in the lower end of the tool which choke varies the mud throughput, thereby varying upstream pressure in the mud circuit, forming an output which can be detected at the surface.

34 Claims, 15 Drawing Figures

FIG. 1
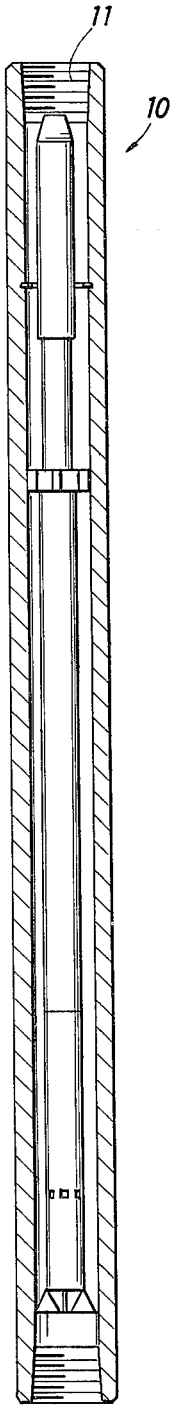
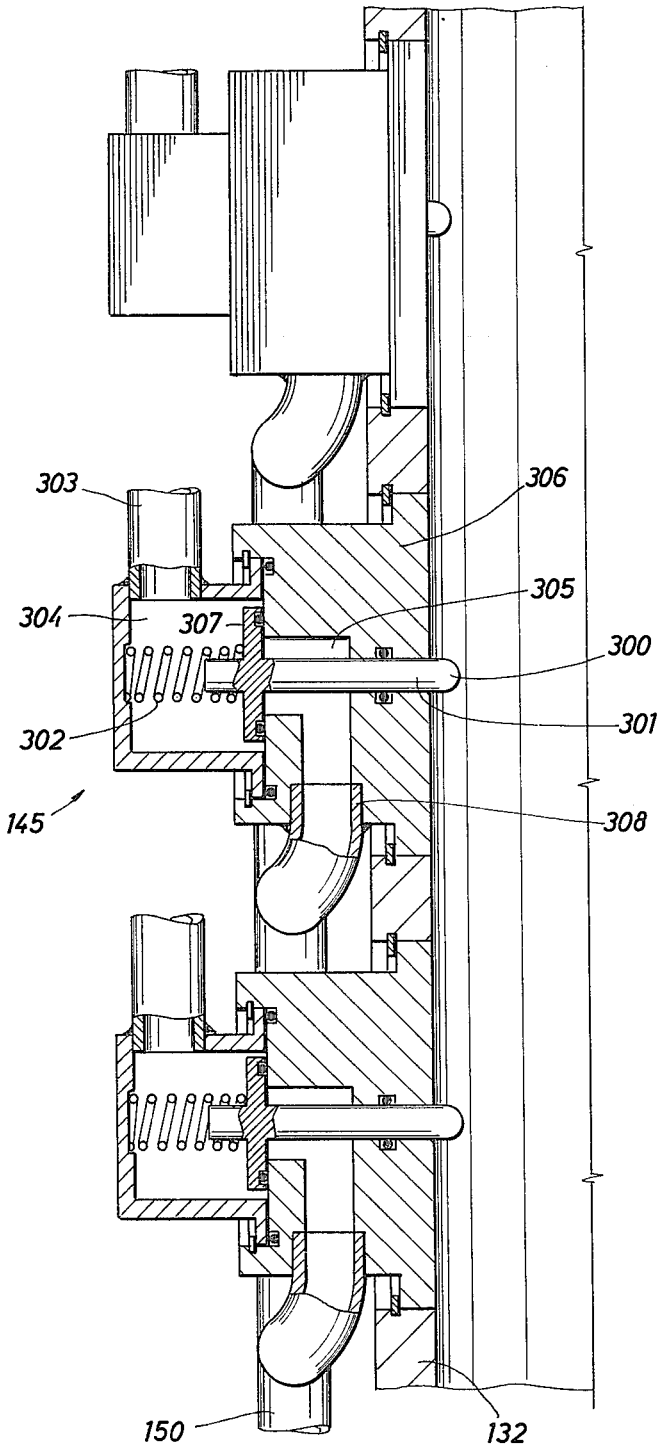
FIG. 6

MEASURING WHILE DRILLING TOOL

BACKGROUND OF THE DISCLOSURE

The present invention is directed to a measuring while drilling tool. Various and sundry measuring while drilling tools have been fabricated in the past. The present invention offers improved performance over them. First of all, this tool does not require internal electrical circuitry, batteries and the like. In some wells, the bottom hole temperature is so high that electrical components are seriously derated and do not perform very well. The present invention is able to perform quite well at elevated temperatures because it is devoid of batteries and electronic components.

The present invention is particularly able to form an indication of the angle of inclination of the tool. In addition to that, it forms an output signal indicative of the heading relative to magnetic north. Other outputs are incorporated. One of the best and most desired sensors is a mechanism indicating the inclination of the tool. This is particularly useful in determining whether or not the tool is oriented vertically or at some other angle departing from the vertical. In the drilling of oil wells, it is often necessary to control their drift or direction. Sometimes, they are intentionally deviated from the vertical. In any case, this must be indicated at the surface to control deviation. Techniques exist whereby angular drift or deviation from the vertical can be measured.

Other sensors can be used. In any event, without regard to the specific nature of the sensors, it is very helpful to further incorporate devices which form two calibration pulses. The calibration pulses serve as references or standards against which the variables can be calibrated. Two are especially helpful. This is helpful to calibrate the output which is read in the mud pressure line connected to the drill string. The attenuation varies as the well drills deeper and deeper. As it drills deeper, it is necessary to compare the calibration signals available. The mud column viscosity encountered as the well becomes deeper may change and thereby vary the signals sensed at the surface, but, as long as the calibration output signals are available, they serve as a comparative standard, and correct data can be read at the surface.

BRIEF DESCRIPTION OF THE PREFERRED EMBODIMENT

The present invention is a drill collar type device in external appearance. It is connected in a drill string, having standard API pin or box connections. It is hollow through its length to provide a flow path for drilling mud. It derives its power from the drilling mud by exposing a pressure responsive piston to the mud so that each drop in the mud pressure on stopping and then restarting the pump pressurizes the movable piston and the hydraulic oil system. The hydraulic oil powers the equipment. The output signal is created by modulating a plug in the mud flow path through the tool. It opens and closes to constrict the mud flow path, creating an upstream pressure variation which is sensed back at the surface.

BRIEF DESCRIPTION OF THE DRAWINGS

FIG. 1 is a side view, partly in section, of the tool of the present invention which resembles a drill collar;

FIG. 6 is a sectional view of hydraulic tubing and valves; and

DETAILED DESCRIPTION OF THE ILLUSTRATED EMBODIMENT

Figure 2:
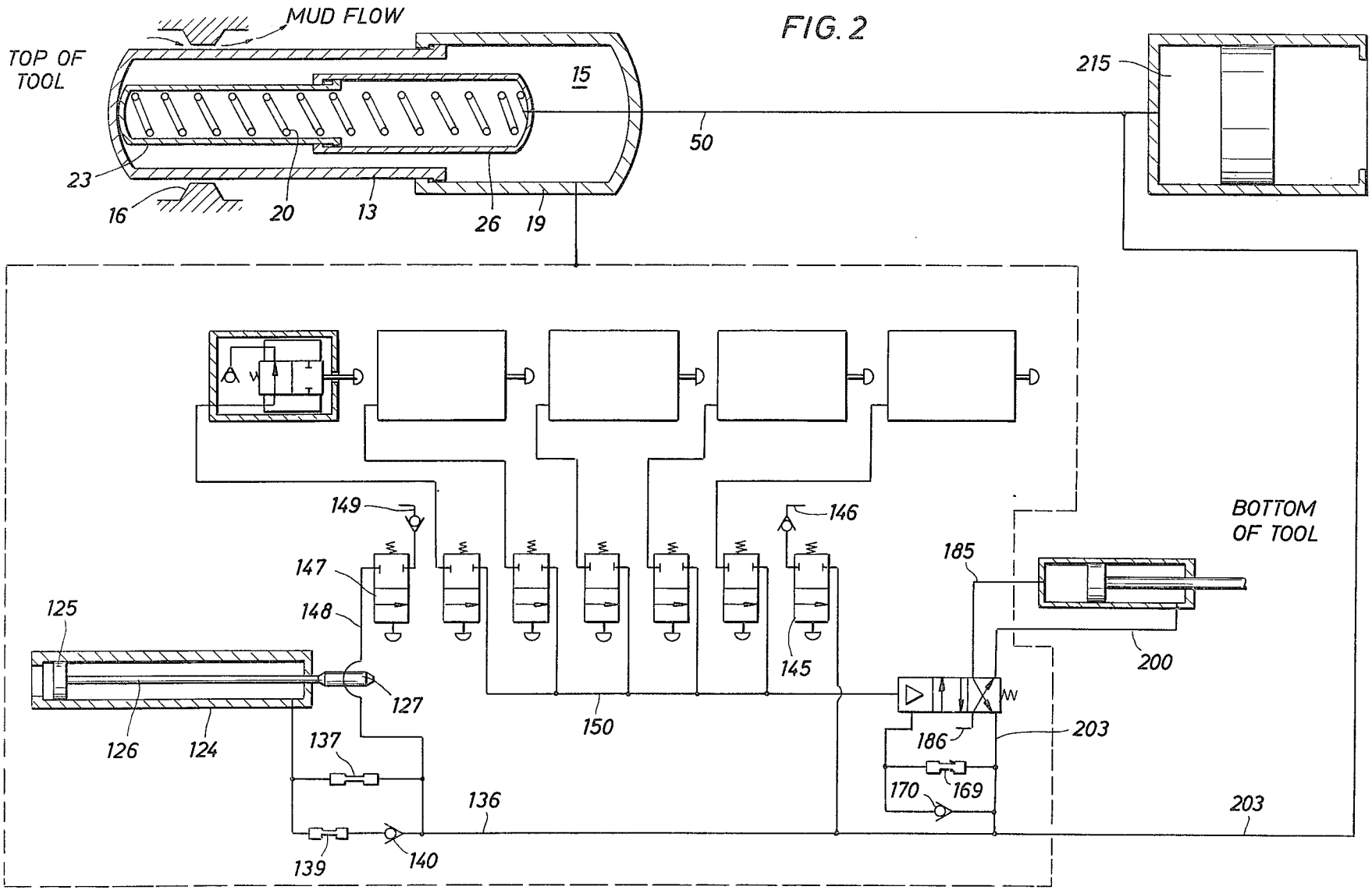
FIG. 2 is a hydraulic schematic of the apparatus, particularly depicting how the variables are converted into hydraulic signals.

The embodiment which is illustrated in the drawings serves as a downhole, dynamic, data capture and signal transmitting device which functions devoid of batteries, electronic components and the like. Restated, it is passive in the sense that it does not require a positive power source. Each time the mud pumps at the surface are shut off and mud pressure drops, this device samples all the data. When the pumps are restarted and mud flow begins anew, data is transmitted to the surface along with two calibration signals. The calibration signals represent the minimum and maximum values of each of the data being transmitted. After transmitting all the data and the two calibration signals, the device shuts off and remains dormant until the mud flow is again stopped, and then the process is repeated.

In FIG. 1 of the drawings, the apparatus is identified by the numeral 10. It is open at the upper end 11 to define an axial passage where drilling mud flows. The drilling mud flows through the tool and out the bottom. The entire tool has a diameter which matches the drill collars in the drill string. It has a cross section area sufficient to enable the mud to flow through it without creating undue back pressure. It does, however, include a plug which selectively restricts the outlet passage so that it is pulsed to thereby form an output signal. The mud, of course, flows through the tool shown in FIG. 1 from top to bottom, and, as it flows out through the bottom, it flows into the next connected member in the drill string. The tool 10 is typically installed among several drill collars just above a drill bit. The number, size and weight of the drill collars can be varied depending on the specifics of the drilling program. In any case, this invention appears on the exterior as a drill collar and functions somewhat as a drill collar. It may not have the same weight, but it does include the apparatus to be described hereinbelow for measuring certain variables during drilling, and, to this end, it is preferably placed relatively close to the drill bit.

The equipment of the present invention encounters difficult circumstances, and, therefore, it is made very rugged. Its ruggedness is enhanced by utilizing a device which functions devoid of electronic components, batteries and the like.

For a better understanding of the structure, attention is next directed to the topmost detailed drawing of the tool 10. This drawing is found in several pieces and thus begins with FIG. 3A.

Figure 3A:
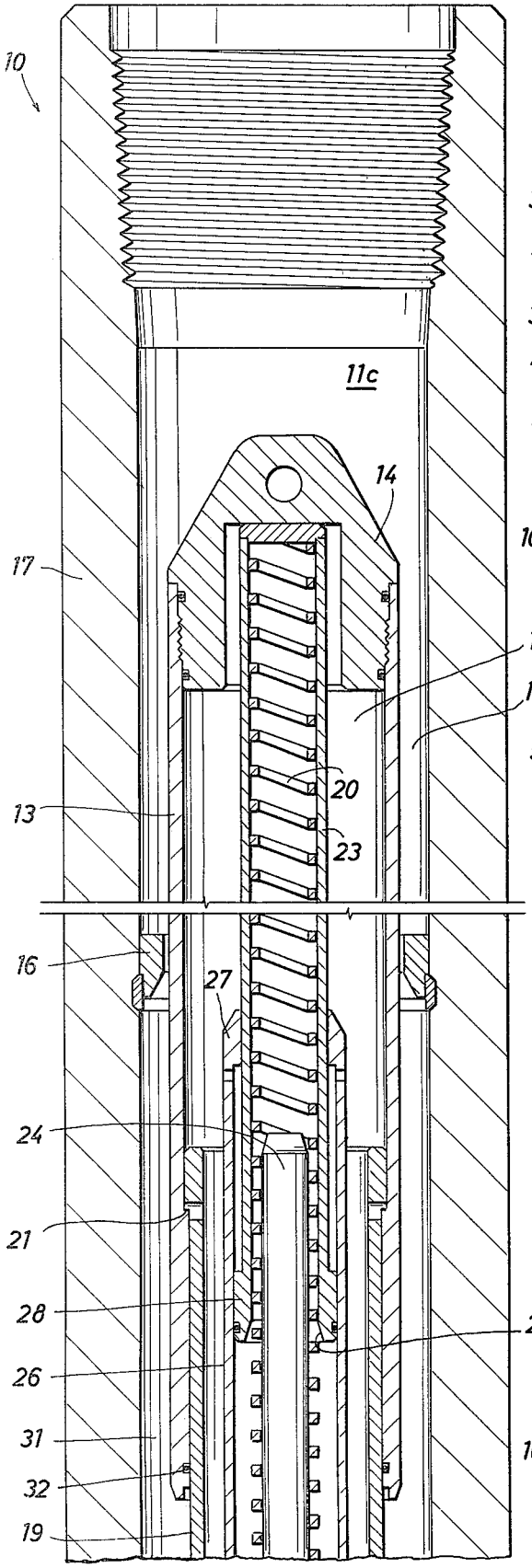
FIG. 3, which is formed of segments 3A through 3H, inclusive, is a detailed, lengthwise, sectional view showing the components of the present invention.

In FIG. 3A, the measuring tool 10 incorporates the axial passage 11 which opens below the standard threaded joint. The opening 11 communicates into a concentric passage 12 extending along the tool to deliver the mud. The total cross sectional area of the passage 12 is sufficient to prevent blockage of the flow of drilling mud. A tubular body 13 is closed off by a cap 14 at the top end. The body 13 is hollow, cylindrical and concentrically located in the annular passage 12. The cap 14 closes it off completely. A lifting eyelet is shown at the upper end. The cap 14 closes over an internal cavity or chamber 15. The chamber 15 is adapted to receive and store oil. The oil fills the chamber 15.

A constriction controls mud passage. It is formed by the shoulder 16. The shoulder 16 is attached to the outer body 17. The body 17 is an elongate, tubular body which encases or houses the measuring tool 10. Moreover, it is the exterior which handles all the wear and tear that is encountered by the present invention.

The constricting apparatus 16 serves to create some back pressure so that the pressure is experienced by the cap 14. The cap is forced down to the limit of travel to thereby cock or set the hydraulic system.

The tubular body 13 is free to move. Its movement is constrained. It telescopes over a slightly smaller tubular member 19. The tubular member 19 is shown in the bottom portion of FIG. 3A. There, it will be observed that the tubular members 13 and 19 have overlapping or latched shoulders. The shoulders catch against one another to limit upward travel. Thus, the cap 14 can be forced downwardly by mud pressure. It is returned upwardly by a spring 20. The spring 20 is a return spring which brings the interlocking shoulders at 21 together. The shoulders 21 thus limit upward travel, and this is shown in FIG. 3A. Downward travel is achieved against the spring 20 which is compressed. The spring 20 is thus a coil spring serving as a return mechanism.

The spring 20 is encased in a guide tubing 23. The tube 23 has substantial length to encase the spring. The spring 20 fits about a stiffening rod 24. The rod 24 is positioned in the spring so that the spring is held concentric of the tubular housing 23. The tubular housing 23 moves down before the outer tubular housing 13 moves down. On upstroke, they move together. The tubular housing 23 is chamfered at 25 to enable it to surround the coil spring 20, functioning somewhat as a funnel. Thus, the tubular housing 23 which moves up and downwardly must pass over the various turns of the spring.

The tubular member 23 is concentric on the interior of a larger tubular member 26. The tubular member 26 is equipped with an upper shoulder 27 which is directed inwardly, while the tubular member 23 has a lower shoulder 28 which extends radially outwardly thereabout. The shoulders 27 and 28 are interlocked. That is to say, the tubular member 23 cannot ride too high and escape. Its escape is limited, and, hence, axial extension is limited by interlocking the shoulders 27 and 28. This traps the spring 20 to prevent its escape.

Ports 30 permit oil to fill by flowing in or out the concentric, annular cavity between the shoulders 27 and 28.

The measuring tool 10 further incorporates an annular passage 31 which carries the drilling mud on the outside of the moving parts. Suitable O-ring seals at 32 prevent leakage. The chamber 15 is an oil reservoir. The chamber 15 is reduced in volume when the cap 14 moves downwardly. The chamber 15 opens into a small passage 33 shown in FIG. 3B. The passage 33 is a relatively narrow, concentric, annular, flow space. The flow space is on the exterior of a solid, cylindrical sub 35. The member 35 joins to the rod 24. Moreover, it is externally threaded so that a threaded joint is made at 36 for attaching the fixed tubular member 26. The sub 35 is hollow with an axial passage 37 which opens into two or three lateral ports opening around the base of the probe 24. The ports 38 connect to the axial passage 37 which opens into the central tubular member 23.

The sub 35 is additionally joined to an outer tubular sleeve 40. The sleeve 40 is centered by lugs 41 spaced around it. It is centered within the outer body 17. The lugs 41 interrupt the external mud flow path. Three or four lugs of relatively thin construction are all that are needed. They hold and center the tubular member 40. The tubular member 40 is a type of mounting for the various concentric members described hereinbefore. It is threaded to the internal sub 35 by a threaded connection 42. The tubular member 40 additionally anchors the external, fixed, tubular member 19 by means of a threaded joint at 43. It will be observed that the joint 43 is protected by O-ring seals at both ends of it. The same is also true of threaded connections at 42 and 36.

The passage 33 is thus between the internal sub 35 and the tubular member 40 around it. The passage communicates with an internal passage 46 which extends to the interior of the sub 35 and turns at a lengthwise passage 47. The passage 47 is parallel to the passage 37 previously mentioned. While they are parallel, they do not intersect.

The passage 47 opens into a cavity or chamber 48. This is a high pressure, hydraulic oil system, and it incorporates a reservoir at 48. A fitting 49 is appended to the lower end of the central sub 35, and it connects with a tube 50. The oil flowing through the passage 37 and the tube 50 will be termed low pressure oil. It is low pressure compared to the pressure in the reservoir 48.

At this juncture, the apparatus will be described in terms of physical placement of the components. It will not, however, be described in terms of a hydraulic system which is better and more easily described referring to the hydraulic schematic incorporated in the drawings. However, concerning placement of the components, this can be fairly well set forth. The components located in the lower part of FIG. 3B, all of FIG. 3C, and the top portion of FIG. 3D are connected in an hydraulic circuit where plural lines are located adjacent the inside wall of the cavity or chamber 48. They are all provided with oil under pressure as will be described.

Figure 3B:
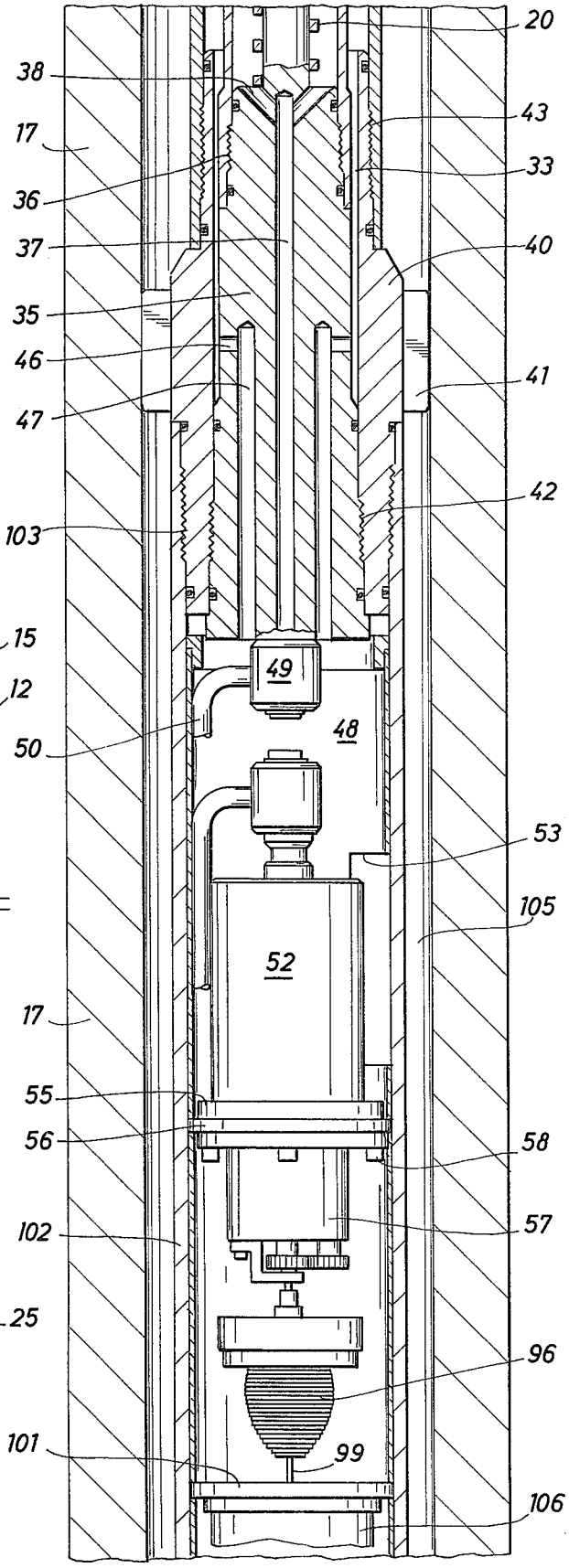

The topmost measuring device is shown in FIG. 3B, and it is a heading device identified by the numeral 52. It is a closed, cylindrical container in FIG. 3B. The container seals and encloses the transducer in the housing 54 which is affixed by a flange 55 to a transversely extending mounting rib 56. The rib 56 is perforated to enable oil flow past it. The rib 56 additionally supports a bracket 57 on its lower side which is joined to the mounting rib 56 by suitable bolts 58. The bolts 58 pass through the rib and also affix the flange 55. The rib 56 is not solid across the apparatus but has openings in it as will be described in FIG. 4.

Figure 4:
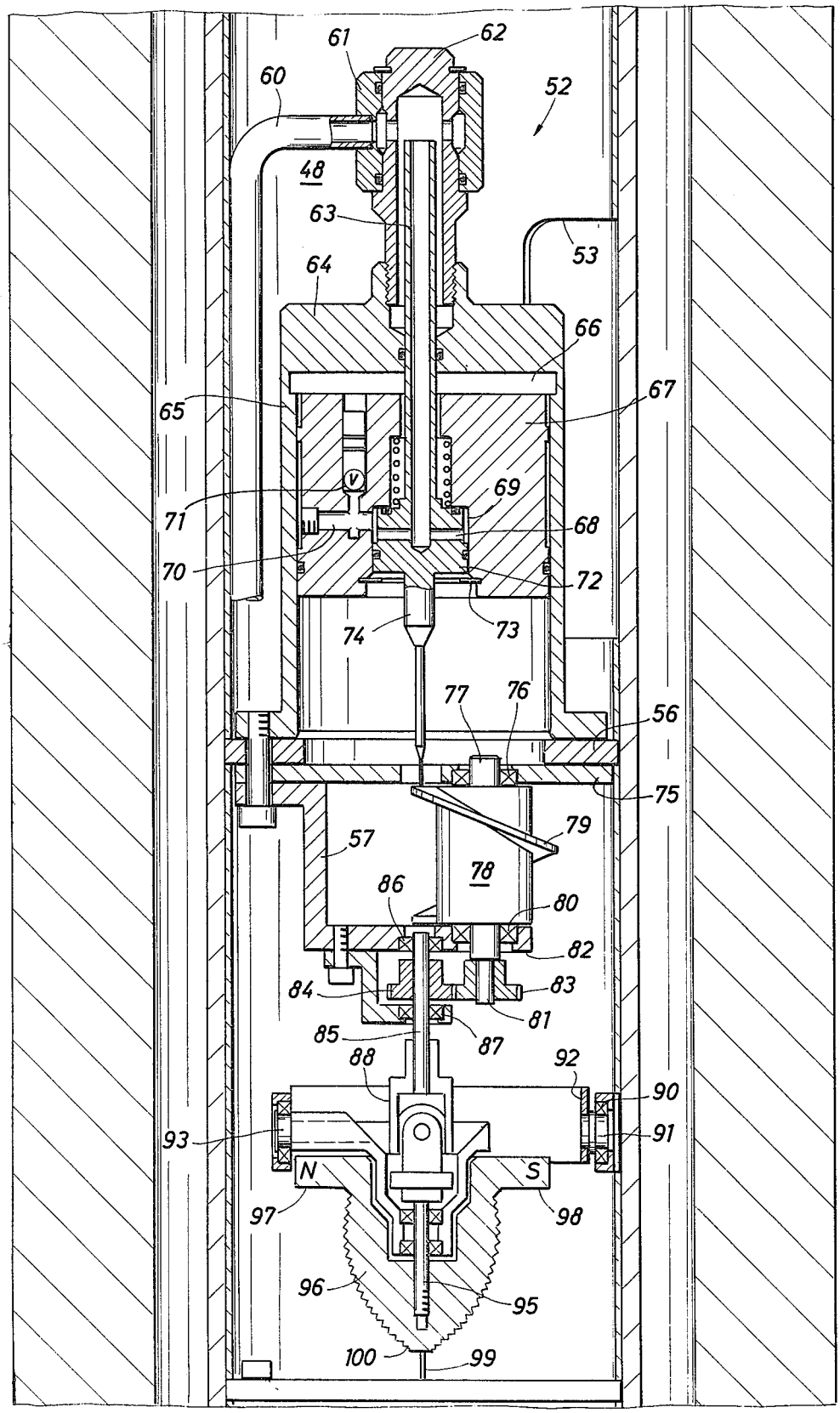
FIG. 4 is an enlarged sectional view showing a means for determining the azimuth of the tool.

FIG. 4 is an enlarged sectional view through the means 52. The means 52 serves as a heating indicator. The apparatus shown in FIG. 4 thus begins with an inlet line 60 where oil is supplied under pressure from a source to be described. It is delivered to a sleeve 61 which surrounds the tip end of a hollow, tubular fitting 62. The fitting 62 has an axial passage for receiving a tube 63. The tube 63 extends into a transverse end closure plate 64. The plate 64 is the top end of the cabinet or housing and further supports a wall portion 65. The wall portion 65 is the outer shell of the container. It serves as a cylinder. An internal cavity is defined at 66. The cavity 66 is adjacent to a movable piston 67. The piston 67 moves and thereby varies the volumetric capacity of the cavity or chamber 66.

Oil is introduced under pressure through the line 60 and flows into the line 63. It is fed outwardly through a lateral passage 68. The passage 68 selectively connects into an annular space 69 and to a radial passage 70. The passage 70 voids hydraulic oil under pressure flowing through a check valve 71 which, in turn, conducts oil from the chamber 66. The cylindrical space 66 is varied in size by movement of the piston 67.

The passage 68 is formed in a small piston 72. The piston 72 is captured in the larger piston 67. It is shown at its upper extrmity of movement and is sealed by operation of a face seal on the upper face. The piston 72 is free to move downwardly against a snap ring 73. This limits its downward travel. Its upward travel is limited by the concentric step drilled into the piston 67. The piston 72 carries an extending probe 74 which is concentric at its center and which extends downwardly to a tip. It passes through an opening in the transverse rib 56. The rib 56 is centrally drilled to provide adequate internal clearance for the probe to extend through it, and the lower housing 57 is, of course, affixed to the lower side.

The mounting rib 56 secures a transverse plate 75. The plate 75 is centrally, axially drilled to permit the probe 74 to extend past it. In addition, a bearing assembly 76 mounts a stub shaft 77 on a drum 78. The drum 78 supports a helix cam 79. The cam extends fully around it and thereby encompasses 360°. The cam is a lip which protrudes by a sufficient distance from the surface of the drum 78 to pick up or block the probe 74. As will be described later, the probe 74 travels downwardly. Its downward stroke is limited by the cam 79. Dependent on the location of the cam as a result of rotation, the probe may move a short distance, or, alternately, it may extend a significant distance. In any event, the cam 79 encompasses 360° around the drum 78. The shortest movement is equal to a zero value, and the longest stroke is equal to 360°.

The numeral 57 identifies a fixed bracket. The bracket supports a bearing assembly 80 which, in turn, receives a shaft 81 therethrough. The shaft 81 is aligned with the stub shaft 77 so that the drum 78 is supported. The bearing assembly 80 is thus in a countersunk opening and held in position by the parallel leg 82 of the bracket 57.

The shaft 81 rotates a spur gear 83 which meshes with a second spur gear 84. The spur gears 83 and 84 have a one-to-one ratio. The spur gear 84 is mounted on a shaft 85. The shaft 85 is held in alignment by a first bearing assembly 86 which is in the parallel leg 82. A second bearing assembly 87 surrounds the shaft 85. The bearings 86 and 87 align the shaft 85. Moreover, it is held in axial alignment with the probe 74. Through the use of the spur gear arrangement, the rotation of the shaft 85 is imparted to the drum 78. They are rotated at the same angular rate, this being the result of the one-to-one gear ratio between the two gears. Accordingly, one full revolution of the shaft 85 rotates the drum 78 by one full revolution.

The shaft 85 is connected by way of a clevis 88 to a universal joint. The universal joint is located at the center of a two-dimensional gimbel system. The gimbel system includes a fixed bearing at 90 supporting a shaft 91, and similar apparatus is placed on the opposite ends. The shaft 91 supports an internal gimbel ring 92. The gimbel ring 92 extends in a full circle and thereby supports a perpendicular mounting shaft 93. The shaft 93 is matched by a similar shaft on the opposite side. The pair of shafts 91 is perpendicular to the pair of shafts 93. Thus, there is a pair of external shafts protruding outwardly from the gimbel ring 92. They define a first axis of rotation. The shaft 93, supported by suitable bearing assembly on the inside of the ring 92, defines a second axis of rotation which is perpendicular to the first. The gimbel mounting thus comprises two perpendicular axes of rotation which are separated by gimbel rings. Moreover, the shaft 85 connects through a clevis 88 which is a portion of a universal joint mounting whereby a downwardly extending shaft 95 is free to hang on the vertical and yet impart rotation to the shaft 85. More specifically, the vertical shaft 95 will rotate and will deliver its rotation to the shaft 85, even though the shafts 85 and 95 are not parallel. The shaft 95 is used as a mounting shaft for a large, weighty pendulum 96. The pendulum 96 adds weight to assure that the shaft 95 hangs in a direction determined by the vertical component of gravity. The weight 96 is sufficiently heavy to maintain the shaft 95 at the vertical. The pendulum 96 is equipped with a transverse magnet comprising a north pole at 97 and a south pole at 98. The magnet is sufficiently strong to be attracted to the magnetic field and thereby rotate the pendulum 96. When it rotates, it rotates the shaft 95. This rotation is delivered through the universal joint 88 to the shaft 85. Its rotation, in turn, is delivered through the spur gears 83 and 84 to the drum 78. It rotates the drum to position the cam 79 for contact by the probe 74.

If the measuring tool 10 is normally used in the vertical, no particular problem arises on transfer of the pendulum rotation and its alignment with the magnetic field. However, it may be in a slant hole. If this is so, the pendulum will kick off to the side or depart from the centerline axis of the tool. This poses no problem because it is then permitted to hang vertically by operation of the two-dimensional gimbel system. Nevertheless, the rotation is still transferred through the universal joint.

The pendulum is thus heavy enough to hang vertically, and the magnet that is formed in it is strong enough to seek out the magnetic north alignment. To this end, it is very wise to make the external portions of the tool near the magnets 97 and 98 of monel or some other metal which does not shield the magnet from the magnetic field of the earth.

The exterior surface of the pendulum is equipped with steps. It is cut in a specific profile. The numeral 99 identifies a centralized probe which extends upwardly for the purpose of determining the angle of inclination. The probe 90 connects with equipment for indicating the inclination. This equipment is very similar to that shown at 52, except that it is inverted. In other words, the probe 99 corresponds to the probe 74 at the top of FIG. 4. The probe 74 is forced downwardly under hydraulic pressure until it contacts the cam 79. By contrast, the probe 99 moves upwardly until it contacts the pendulum 96. If the tool is perfectly vertical as determined by the gravity positioning of the pendulum 96, then the probe 99 is at its minimum extension. The probe 99 is limited by the contour of the external surface on the pendulum. The pendulum thus includes a number of steps at 100. The first step can correspond to an angle of inclination of one degree. This step is located a specific distance from the probe 99. In other words, the probe 99 is shown at its minimum extension corresponding to 0° inclination. When the probe extends to contact the next step, it will extend by a specified length, say, 0.02 inches. The inclination is incrementally identified by increasing steps. As the angle of inclination from the vertical increases, the probe 99 strikes at a more remote step and thereby converts the angle of inclination into linear movement of the probe 99.

The steps 100 extend all the way around the pendulum 96. Thus, each defines a plateau cut in the exterior having a height difference equal to the calibrated norm. Deflection of the pendulum from the axial position shown in FIG. 4 thus still positions a facing surface for the probe 99. Each step is cut normal to a radial line from the pivot of the gimbel system to be perpendicular to the probe tip.

The probe 99 is shown in the lower portions of FIG. 3B. There, a mounting rib 101 spans the interior of the chamber. The rib 101 is parallel to the rib 56 previously mentioned. Both ribs are positioned on the interior of a thin walled long tube inside a hollow, tubular member 102 which is threadedly joined at 103 to the tubular sleeve 40 previously mentioned. The threaded joint is protected by suitable O-ring seals to prevent leakage. The tubular sleeve 102 is on the interior of the outside body member 17 to define an annular space 105. The annular space 105 is the annular space where the mud flows through the tool.

Figure 3C:
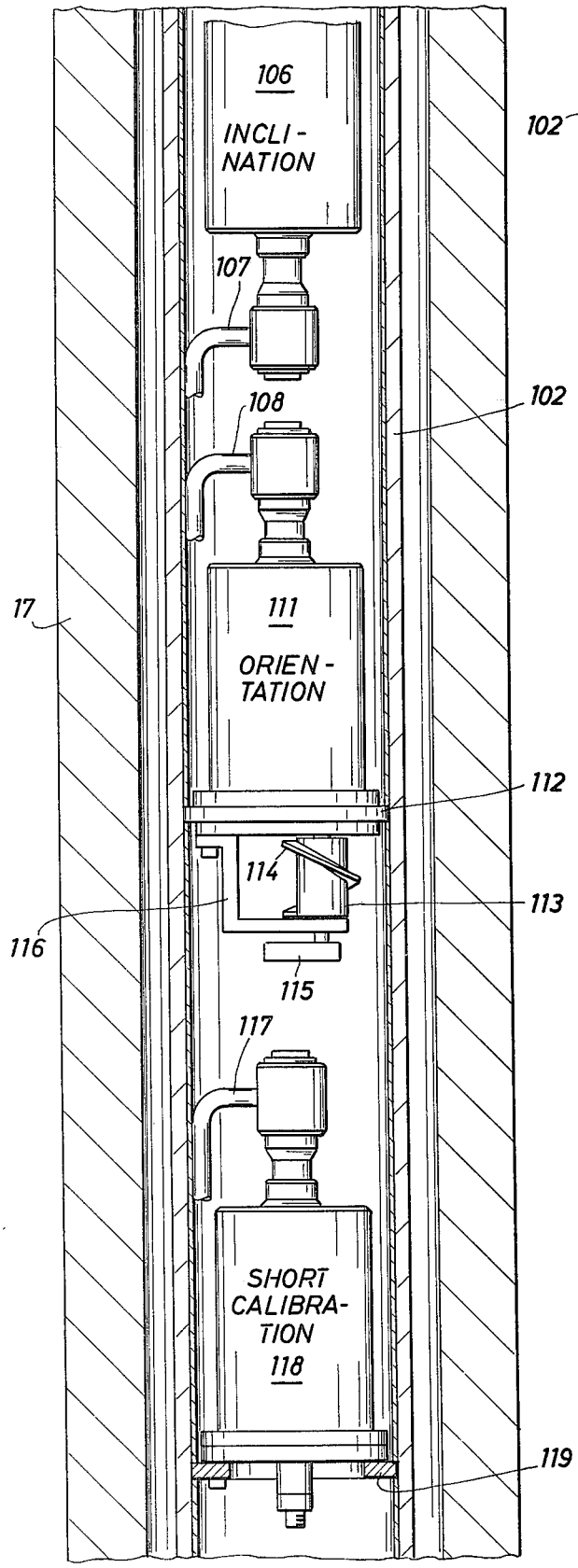
Figure 3D:
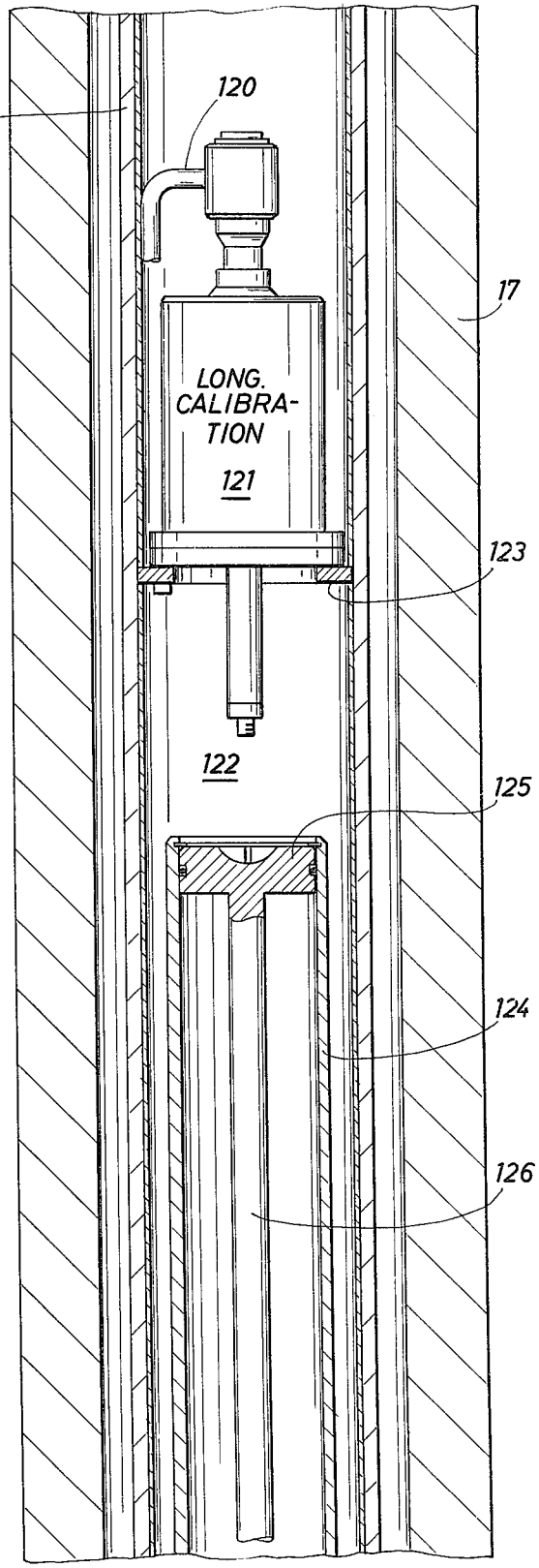

Attention is next directed to FIG. 3C where the numeral 106 identifies the housing for the inclination encoding device which is affixed to the transverse mounting rib 101. The device is identical to the heading apparatus 52 previously discussed. Again, it is equipped with a suitable hydraulic feed line 107. The connection of this line will be described in detail later.

The numeral 108 identifies yet another hydraulic line similar to the line 107. It connects through the rotatable bushing similar to the one found at the top portions of FIG. 4. It provides hydraulic oil for operation of an orientation device 111. The orientation device 111 is supported on a transverse mounting rib 112. It has a closed housing which is similar in construction and operation to the apparatus better shown in FIG. 4. That is to say, it utilizes a piston within a piston arrangement having a protruding probe. The probe extends adjacent to a drum 113 on which a helix cam 114 is supported. The helix cam is rotated to a specified position determined by a pendulum arm 115. The arm 115 is supported on a shaft with suitable bearings aligning the shaft and the drum 113 for rotation. Again, the same construction as that shown in FIG. 4 is used to support the drum 113. To this end, a mounting bracket 116 extends from the lower side of the mounting rib 112. It includes suitable bearing assemblies for reducing friction.

The arm 115 has sufficient weight to cause it to hang downwardly. It will hang down continuously without interruption at any time the tool is not vertical. If the tool is perfectly vertical, it will assume whatever position it had theretofore. Such a reading is meaningless. It is meaningless because it occurs at a point in time when the pendulum 96 is hanging vertically, and the inclination signal identifies the vertical position of the tool. The orientation angle is referenced to a fixed key in the tool to be consistent relative to the tool 10.

FIG. 3C further incorporates an additional signal generating apparatus which is supplied with a hydraulic line 117. It is the apparatus at 118 which forms a short calibration output pulse. It is mounted on a suitable mounting rib 119 which extends transversely across the tool. Continuing with FIG. 3D, there, an additional hydraulic line 120 provides hydraulic oil under pressure for a long calibration device 121. The devices 52, 106, 111, 118 and 121 all operate in the same manner, that is, utilizing the piston within a piston arrangement previously described. They encode different measurements. The signal forming means 118 and 121 form calibration pulses. One is short, and the other is comparatively long.

The numeral 122 identifies a chamber which is communicated with the tool interior including the chamber 48 above. It is spanned but not closed at the upper end by the transverse mounting rib 123. The signal generator 121 is mounted above it. In the chamber, a cylinder 124 encloses a movable piston 125. The piston is exposed to oil in the chamber. The piston 125 is mounted on a piston rod 126. The rod 126 transfers movement of the piston 125 to an enlargement 127 shown in FIG. 3E. The enlargement 127 is supported on the bottom end of the piston rod 126.

The piston rod 126 is guided by a sub 130 which is attached to the lower end of the sleeve 124 by a threaded connection found at 131. This closes off the lower end of the cylindrical member 124. The threaded connection 131 is protected by suitable O-ring seals at both ends of the thread. The O-rings are seals and also serve as hydrostatic locks. The hollow sub 130 is axially drilled with a passage permitting the piston rod 126 to extend all the way through it. The piston rod supports the enlargement 127 below the hollow sub 130. The enlargement 127 is found in a hollow, tubular member 132. The hollow, tubular member 132 is a centralized appendage beneath the hollow sub 130, and it has a length sufficient to accommodate the stroke of the enlargement 127.

The enlargement 127 serves as an actuator. It moves past a detent 133 which protrudes into its path. The apparatus incorporates seven values, one exemplified in FIG. 6, which valves are better shown in the hydraulic schematic of FIG. 2. Each valve is a spring biased, detent operated, two-position valve. They are mounted on the exterior of the tubular member 132 and incorporate the protruding detent which is actuated by the enlargement. The enlargement 127 has a size and shape which push the detent aside, overcoming the spring bias and opening the valve. There are seven. They are all identical, except that they vary in their position or location along the tubular member 132.

Five of the seven valves are associated with the five signal generators. A sixth valve serves as a fill valve, and the seventh valve is a dump valve. The tubular member 132 is open at the lower end. The enlargement 127 travels the full length of the tubular member 132. It is returned by forcing the piston 125 back to the top end of its stroke as shown in FIG. 3D. It is moved upwardly by introducing oil under pressure in a line 136. The line 136 is input to a choke 137. In addition to the choke 137, the line 136 forks to another input choke 139 and a series check valve 140 input to the chamber beneath the piston 125. This arrangement of the check valve 140 and two inlet chokes allows a faster upstroke and controlled downstroke.

Each valve is thus shown mounted on the side of the tubular member 132. Six are located on the left side of FIG. 3E, and the last, whch is the dump valve, is located on the lower right extremity. It is the last detent to be contacted by the enlargement. When it operates, pressure is dumped from the chamber 15 to an accumulator.

Attention is momentarily directed to FIG. 2 of the drawings. There, the piston 125 and the enlargement 127 moved by it are identified. The line 136 is input to the cylindrical member 124 for urging the piston 125 back to the top end of its stroke. The enlargement 127 is aptly positioned relative to the seven valves, and the most remote of the seven from it in the schematic is the dump valve 145. The dump valve is normally closed when the enlargement 127 encounters it at which time it is opened. When it is opened, hydraulic oil from the checkvalve 146 flows to the line 136 and to the sump. The line 136 delivers hydraulic oil beneath the piston 125 (see FIG. 3E) to force it back to the top end position. As it moves, it strikes all of the detents and triggers every valve. It travels until it reaches the extremity of its stroke. At the extremity of its stroke, it trips the fill valve. That valve is identified by the numeral 147. It connects through a short line 148 to the line 136. The valve is connected by a line 149 through a suitable check valve to the high pressure source. Operation of the equipment will be described later.

Returning now to FIG. 3E of the drawings, all of the detent operated valves, except those associated with filling and dumping, connect to a common manifold line 150. The line 150 passes adjacent to the detent operated valves on the left side of the drawing. The line 150 is input to a control means 151. The control means 151 is enclosed in a sealed cannister or housing which is supported by the transverse mounting rib 152 shown at the top of FIG. 3F. For an understanding of this equipment, attention is directed to FIG. 5 of the drawings.

The control means 151 incorporates a closure or cap plug 154 at the top end. The plug 154 is held in position by a snap ring. A suitable O-ring seal around its exterior prevents leakage between it and the surrounding cylindrical body 155. The line 150 opens through a port into a chamber. The line 150, being a collective manifold, inputs oil adjacent to a piston 157. The piston 157 is received in the tubular container or external housing 155. It is forced upwardly by a coil spring 159. The spring bears against a surrounding lip on the piston. The spring is supported on a shoulder 160. The should 160 is at the bottom of an enlarged chamber within the hollow, cylindrical member 155.

The piston 157 has a large skirt at the top end and reduces to a smaller diameter. It has several steps so that the skirt at the top end is the largest, the portion 161 is smaller, the portion 162 is smaller yet, and the portion 163 is smaller yet. The portion 163 is a relatively long, hollow tubing affixed to the bottom end of the piston. The enlargement 162 defines a shoulder for an abutting coil spring 165. The coil spring 165 bears against a sliding ring 166. The ring 166 is carried on the probe 163. Because it moves with the enlargement 162 which has the other shoulder confining the coil spring 165, the spring ordinarily has a fixed extension. It does not flex or elongate. This is true in the ordinary circumstances. However, when the piston 157 travels through an adequate stroke, the ring 166 bottoms out. The ring ordinarily rests on a snap ring in the tubular member 163. It bottoms out against the shoulder 167. The shoulder 167 seals against the ring 166 which incorporates a face seal. The face seal is incorporated to controllably prevent flow along the probe 163.

In operation, a variable quantity of oil is dumped from a transducer when it is interrogated and is delivered through the detent operated valves shown in FIG. 2, delivered through the manifold 150 and input above the piston 157. The piston 157 is moved when oil is introduced to it. Oil does flow past the piston through a choke 169. The choke 169 is connected and parallel with a check valve 170. The check valve 170 opens into an axial passage 172 which also connects with the choke 169. The passage 172 extends the length of the tubular extension 163. More will be noted concerning this later.

The numeral 175 identifies a transverse mounting rib. It supports the housing 155. The housing 155 is joined to it by suitable mounting lugs and bolts at 176. The tubular housing 155 is internally threaded at 177 and supports a lower tubular housing 178 therebelow. The tubular housing 178 extends upwardly to the shoulder 167. Thus, the face seal 166 is carried against the shoulder 167 to selectively seal and close off the exterior passage around the tubular extension 163.

The conduit 136 opens into the tubular housing 155 at a fitting 180. The fitting introduces oil on the exterior of the piston 157. Oil flows from the conduit 136 and into the passage 172. If the piston is up, the face seal ring 166 is raised, and oil is permitted to flow through the passage 182, which is the annular space surrounding the tubular extension 163 at the bottom of the piston. Thus, there are two passages in the assembly shown in FIG. 5. One is on the inside at 172, and one is on the exterior at 182. The exterior passage is made operative by upward movement of the face seal ring 166. Oil flows through the annular space 182 from the enlargement 183. The enlargement 183 is formed in the lower tubular member 178 which has the same external diameter as the cylindrical housing 155. The enlarged ringlike receptacle 183 connects through a lateral port 184 to a tube 185. The tube 185 delivers oil from below as will be described. The tube 185 connects through a suitable fitting which is secured by a snap ring into a counterbored opening in the body 178.

From the foregoing, it will be understood how the line 136 always carries oil to the sump. The line 185 is valve controlled which occurs when the face seal ring 166 is in the up or illustrated position, and such communication is prevented when it is in the down position.

Figure 5:
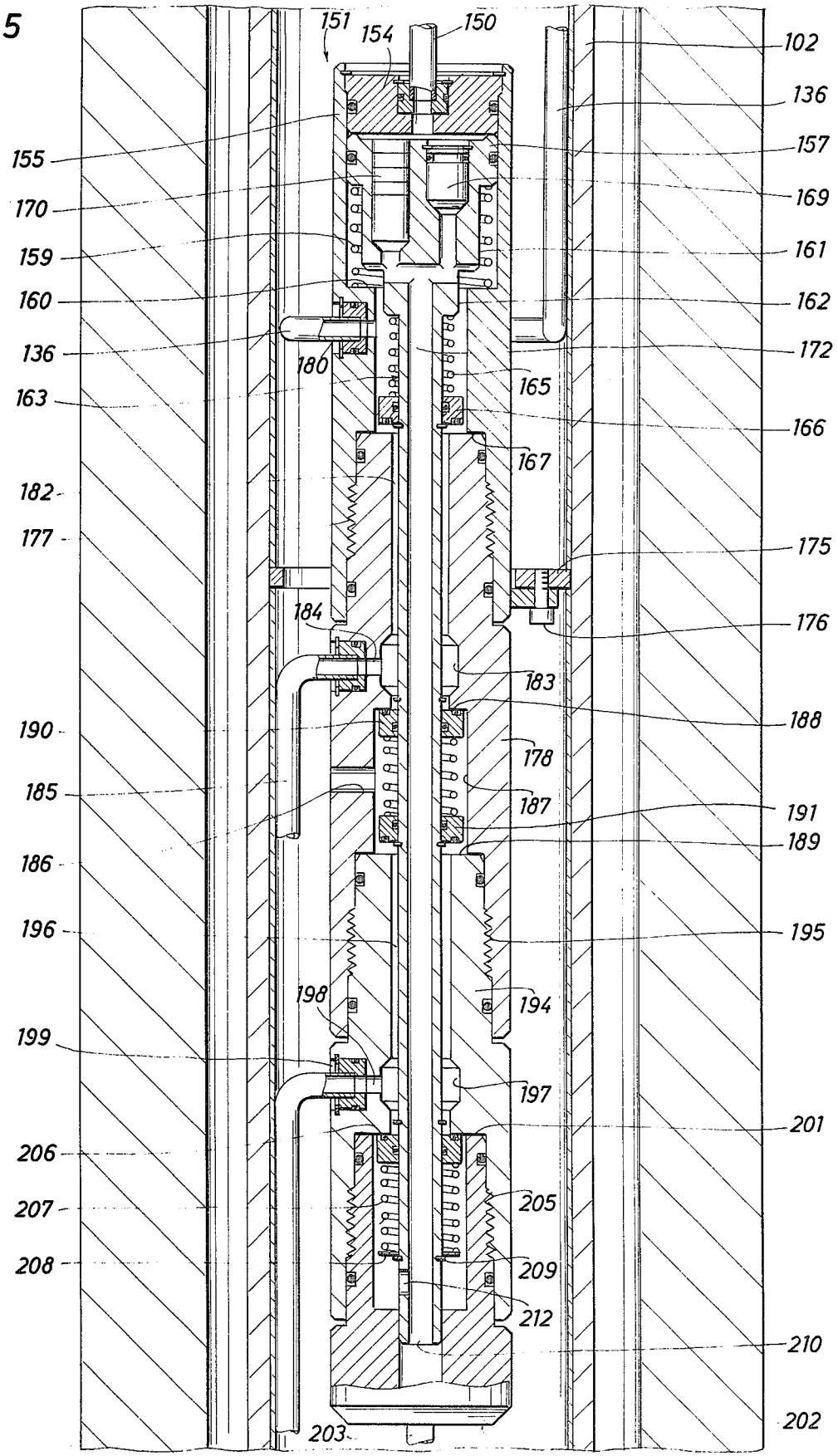
FIG. 5 is a sectional view, in addition to FIG. 4, which sets forth a manifolding system.

The apparatus in FIG. 5 is surrounded by oil under pressure. The numeral 186 identifies a port from the exterior to the interior to introduce oil. This hydraulic oil is under pressure, and the source serves as a reservoir. Oil is introduced under pressure into an enlarged counterbore passage 187. The passage 187 has an upper shoulder 188 and a lower shoulder 189. These facing shoulders confine face seals 190 and 191 between them. The face seals 190 and 191 are include seal rings around the tubular member 163 which are free to slide. They are forced apart by a spring 192. Each one is limited in its position by a snap ring placed in a groove around the hollow tubular extension 163. It will be observed that the face seals are operative when they abut the facing shoulders 188 and 189. No seal is formed until they contact the facing shoulder. The shoulder 189 is the upper end of a threaded, lower housing member 194 which is the last component of the assembly shown in FIG. 5. It is joined by threads at 195 to the intermediate tubular member 178. Again, it will be observed that members 155, 178 and 194 have a common external diameter to define the sealed assembly shown in FIG. 5. Seals are incorporated at the threaded joints 177 and 195 to prevent leakage.

The passage 186 is selectively communicated with the outlet passage 185 when the seal 190 is down. Alternately, oil introduced through the passage 186 will flow downwardly in the interior annular space 196 which is an extension of the annular groove space 182 above. Access to it is selectively controlled by the face seal ring 191. When the movable tubular member 163 is in the down position, the seal ring 191 is closed. The passage 196 extends downwardly to an enlarged ringlike, internal cavity 197. A port 198 is formed in the body 194, and it communicates with a counterbored opening where a fitting 199 is located, and the fitting 199 receives a conduit 200. The conduit 200 extends below for purposes to be discussed.

The tubular body 194 incorporates an internal shoulder 201 which faces downwardly, and a threaded end cap 202 is positioned against it. The cap 202 closes off the lower end of the interior of the tool. The cap 202 is hollow so that a conduit 203 can connect to other equipment therebelow. The cap 202 has a rather long skirt with threads to form the threaded connection 205. The cap threads up against the shoulder 201. The shoulder 201 further serves as a seat for a movable seal ring 206. Seal ring 206 bears upwardly against the shoulder. It is forced upwardly by a coil spring 207. The coil spring is supported on a washer 208 which, in turn, is received on a snap ring 209.

The lower end of the tubular extension 163 has two openings, one identified by the numeral 210 and the other a lateral opening at 212. The lateral opening is selectively communicated with the conduit 200. This connection is closed off if the face seal ring 206 is in the up position. The axial passage 172 opens to the lower conduit 203 through the opening 210 at the bottom end.

Figure 3E:
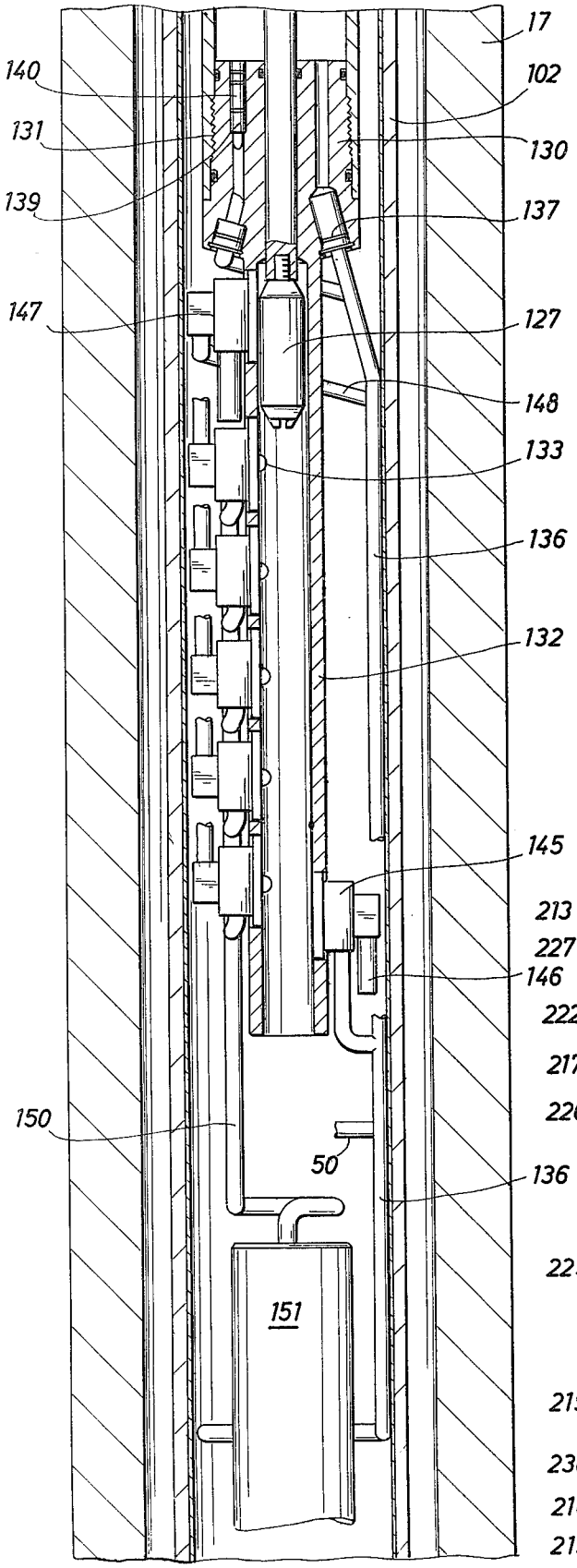
Figure 3F:
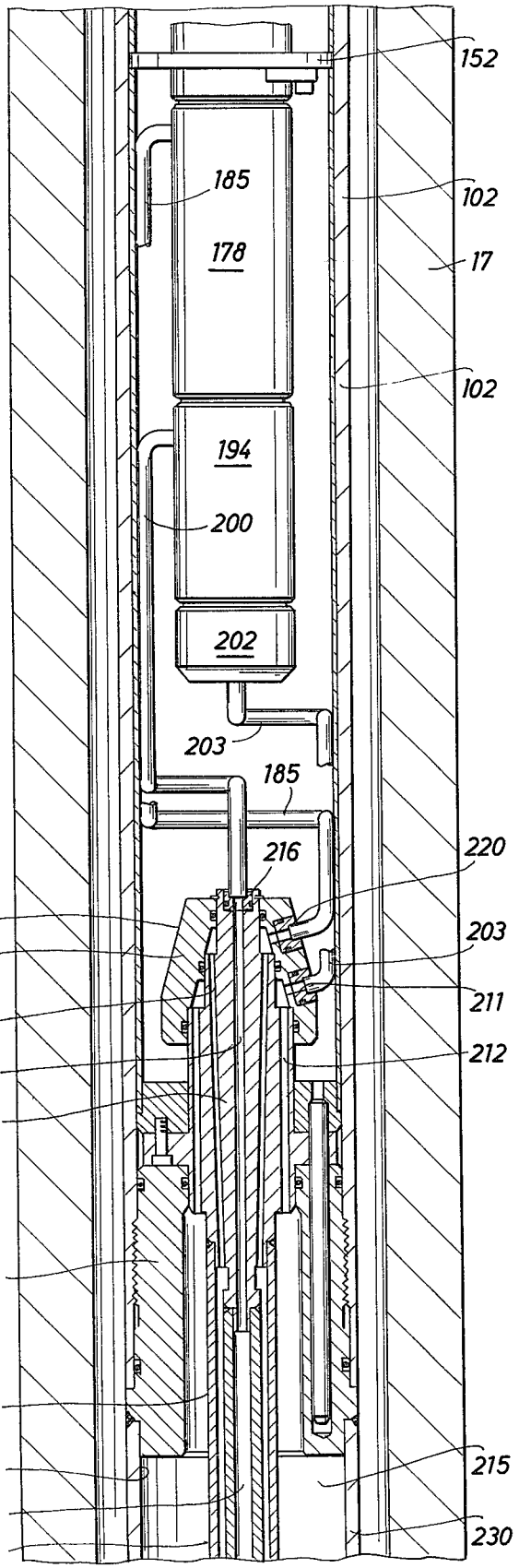

The valve assembly shown in FIG. 5 is, in effect, a spring biased, piston driven, four-way valve assembly. Referring to FIG. 2 of the drawings, the numeral 203 identifies the conduit which dumps to the sump. This conduit is also shown in FIG. 3F. There, it connects to a centralized adaptor fitting for converting the three conduits into concentric conductors. In the lower portions of FIG. 3F, the numeral 213 identifies the adaptor. It is provided with three separate conduits. It connects them together so they form concentric conductors. One conduit is identified by the numeral 203 which is input to a port 211 which, in turn, connects with a set of small passages 212. These passages extend downwardly and open into a closed hydraulic oil reservoir at 215. Three or four passages 212 are spaced around the converter 213.

The tubing 200 is input axially at the port 216. The port 216 opens to an axial passage 217 which extends through the converter 213. The passage 217 continues along the tool, extended by the center concentric tubing 218 at the bottom of the drawing. The passage 217 thus utilizes the conduit 218 to extend therebelow. A large conduit 219 is concentric around the conduit 218. It is connected to the tubing 185. The tubing 185 is input at a port 220 formed in the side of the converter 213. That port communicates with a set of internal passages at 222, the several passages 222 coming together to introduce hydraulic oil on the exterior of the conduit 218 and the interior of the conduit 219.

In the lower portions of FIG. 3F, it will be observed that the outer tubular member 102 terminates and is threaded to a hollow fitting 225. The fitting 225 supports the central drilled body 226 which, in turn, receives the converter 213. The converter 213 closes over the top end of the central fitting 226. The converter 213 has the ports in it for the three conduits mentioned. The cap fits over to form a seal at various O-ring seals on its interior surface, thereby enabling the three individual conduits to be connected to the cap. The tubular body 225 thus serves as an anchor. Because it is threaded to the outer shell 102, it is fixed in location and is a solid anchor for the constituent parts.

Figure 3G:
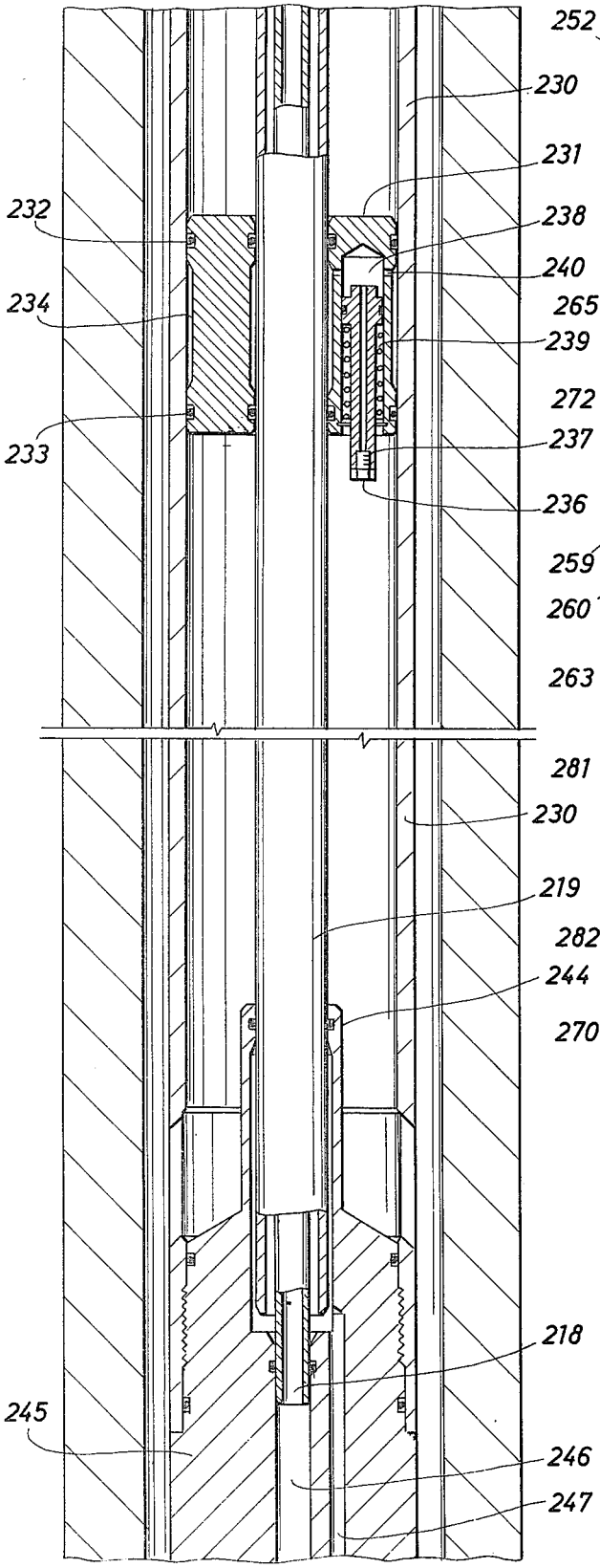

Going to FIG. 3G, the numeral 215 identifies the oil reservoir. It is enclosed by an outer tubular wall 230 which extends upwardly to the lower portions of FIG. 3F where it is welded to the fitting 225. The conduit 219 passes through the center. A seal member is found at 231. The seal member 231 is a doughnut shaped plug which surrounds the tubing 219. The seal 231 has an upper O-ring seal 232 and a similar lower seal ring 233. It has a fairly broad outer surface. This outer surface is recessed slightly to form a slight encircling indention 234. Similar seals and a shallow dished out area are on the seal ring 231 adjacent to the internal conduit 219.

The seal is energized with heavy lubricating grease under high pressure. An alemite fitting 236 at the lower end of a movable plunger 237 permits lubricating or packing grease to be introduced through the axial passage in the plunger to a chamber 238. The chamber 238 is pressurized. The plunger 237 is surrounded by a coil spring 239, and the coil spring forces the plunger upwardly to compress packing grease in the chamber 238. The chamber 238 communicates by an external port 240. The port 240 opens to the exterior of the seal ring 231 between the O-ring seals 232 and 233. The same lubrication is accomplished on the interior adjacent to the conduit 219.

The small port 240 enables packing grease under pressure to flow to a place between the outer seals. Hydraulic oil is stored above the seal ring 231. It is exposed to drilling mud below. It is very important to prevent mud from intruding into the area where the hydraulic oil is located. The packing grease is placed in the seal ring 231, and, with adequate pressure, it prevents any intrusion. Fortunately, the packing grease is soluble in the hydraulic oil. Because this is so, the hydraulic oil is maintained at a specified pressure, while the packing grease is maintained at a higher pressure. The plunger 237 is an indicator of whether or not additional grease is required. If the plunger is extended substantially indicative of significant compression on the spring 239, the extension of the plunger is read as an indicator of the grease remaining in the reservoir 238. As the grease is slowly lost, the plunger 237 responds to reduced pressure and retracts into the seal ring 231. Accordingly, the spring 239 serves as a feed for the grease reservoir.

The tubular member 230, still centered in the outer shell 17, extends downwardly to additional components shown in the lower portion of FIG. 3G. The tubular member 219 is connected into a top fitting 244 of a crossover connector 245. The crossover connector 245 is threaded to the tubular member 230. The tubular crossover connector 245 has an external diameter equal to that of the tubular member 230 which, in turn, equals that of the member 102. This defines a smooth and consistent cross sectional area on the interior of the drill collar body 17. Again, it must be kept in mind that the mud flows in the annular space between these members.

The crossover connector 245 is a fairly substantial tubular structure of significant wall thickness having an internal passage 246. The passage 246 is aligned with an open to the centralized tubing 218. It will be recalled that the tubing 218 is on the interior of the tubing 219. The tubing 218 thus delivers hydraulic oil under pressure in series with the passage 246. In like manner, hydraulic oil flows under pressure on the exterior of the tubing 218 and the interior of the conduit 219. A crossover is achieved for delivery of this oil under pressure to a parallel passage 247. The passage 247 is parallel to the passage 246, and the two of them both extend downwardly as will be described.

Figure 3H:
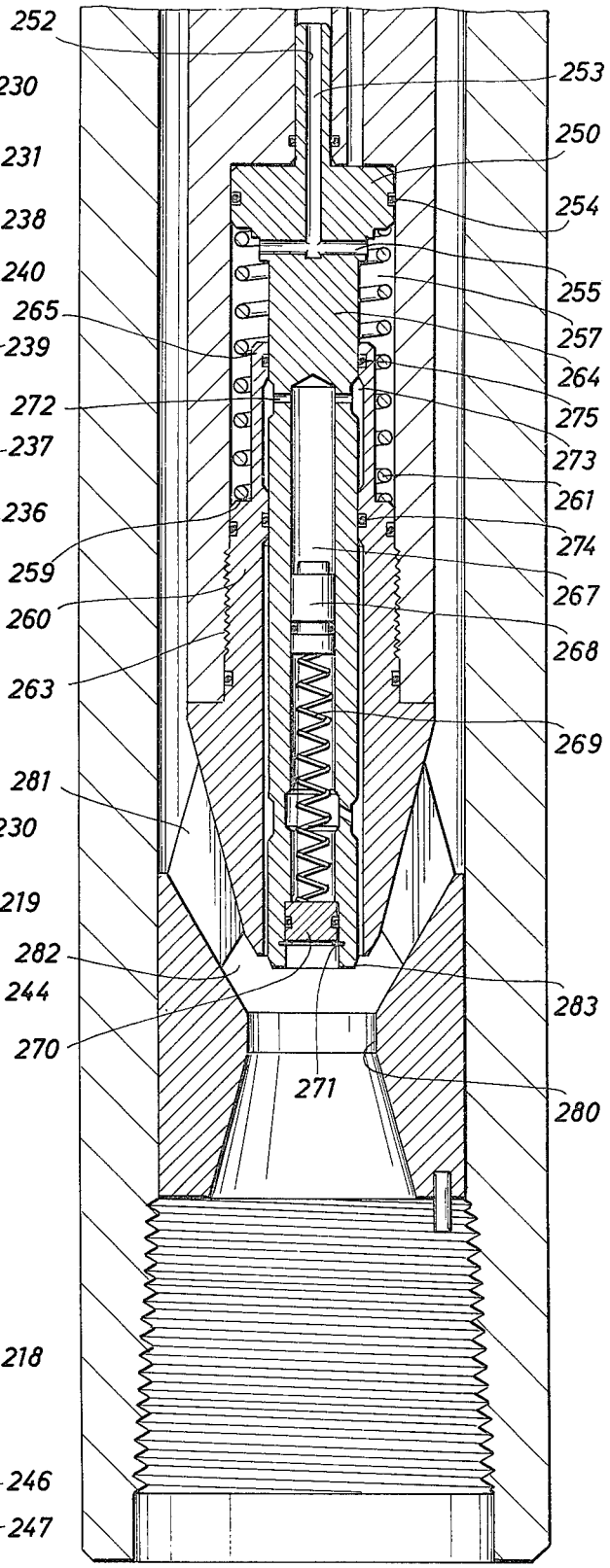

In FIG. 3H, the solid tubular crossover connector 245 is shown positioned on the interior of the drill collar body 17. Mud still flows in the annulus around the crossover body 245. The passage 247 opens into a hollow chamber above a piston 250. The piston 250 is located axially centrally of the crossover body 245. The piston 250 is received snugly in the chamber, and a suitable O-ring seal around the piston prevents leakage. The piston 250 has an upwardly extending stub 252 which is positioned in the passage 246. The centralized stub 252 is hollow. It seals with the passage 246 by a suitable O-ring seal thereabout. The passage 246 is in fluid communication with an additional passage 253 opening downwardly to the bottom side of the piston 250. The piston seals at a seal member 254. The passage 247 opens above the seal or on the top side of the piston. The passage 253 extends to the bottom side of the piston where the passage 253 branches at an outlet opening 255. The lateral opening 255 is duplicated at two or three locations. The passage 255 introduces fluid under pressure below the piston. A chamber 257 is defined in this vicinity. It is defined on the interior of the chamber 258 of the tubular body 245. It is located below the piston head 250. It is located above a shoulder 259 of a threaded plug 260 found at the bottom of the tubular crossover 245. The piston 250 is biased upwardly by a coil spring 261. Oil under pressure which is introduced through the passage 253 flows into the chamber 257 to thereby force the piston to the upward extremity of its stroke, this being shown in FIG. 3H.

The spring 261 bears against the lower shoulder of the piston 250 and the upwardly facing, external shoulder 259 of the fixed threaded plug 260. The plug 260 is equipped with threads so that it makes a threaded connection at 263 with the body 245. This connection is leakproof. It is made leakproof by incorporating suitable O-ring seals above and below the threads.

The threaded member 260 has an alignment guide or skirt 265 which extends upwardly. It is adapted to center and positioned about the lower portions of the piston 250, that portion being identified by the numeral 264. The piston includes the appended plunger or rod 264 which extends therebelow. It is aligned with the hollow, tubular skirt 265 of the fixed, bottom, tubular member 260. The member 260 is axially drilled with a hollow passage. The passage is centered in the extending, centralized, upper skirt 265, which encloses the piston rod extension 264. The rodlike extension 264 appended to the piston 250 is axially hollow, there being a central passage 267. The passage 267 is closed by a plug 268. The plug is forced upwardly by a coil spring 269. The spring is captured by an end closure plug 270 which, in turn, is held in place by a snap ring in the groove at 271. The cavity 267 is adapted to receive packing grease. This grease is fed through a small port 272 into a shallow indention 273 cut around the exterior surface of the rod 264. Grease of a heavy weight is filled into the cavity 267 and packs the exterior between the members and is limited in upward and lower flow by O-ring seals at 274 and 275. The seals 274 and 275 isolate drilling mud from hydraulic oil. Hydraulic oil is located thereabove, while drilling mud is located below. Mud flows up to the seal 274.

The piston 250 is driven downwardly when suitable pressure is applied to it through the passage 247. When it moves down, it compresses the spring 261. Moreover, the lower end portion of it extends into the narrow choke passage 280. The passage 280 is a constraint on the flow of drilling mud flowing through the tool. The body 260 is supported on two, three or four positioning vanes 281. The positioning vanes define angled passages 282 which focus into the narrow passage 280. When the piston 250 is moved downwardly, it positions the tip 283 in the passage 280. The passage 280 is significantly closed. When this occurs, it generates a pressure pulse through the testing tool 10 and thereby forms a signal which can be detected at the surface.

Returning to FIG. 5 of the drawings, the piston 154 moves upwardly and downwardly. The piston 250 in FIG. 3H also moves up and down. It is, in effect, slave to the other piston. To this end, the conduits 185 and 200 emerging from the four-way, multiport valve shown in FIG. 5 are connected so that the two move in unison. It is possible for them to move in opposite directions, but, for convenience of understanding the operation of the device, it is preferable that they move in the same direction. That is to say, when the piston 154 moves up, the piston 250 moves up. As a consequence, the conduits 185 and 200 are shown in FIG. 2 symbolically connected so that the piston 250 is up.

Attention is next directed to FIG. 6 of the drawings. There, one of the identical valves is shown. The valves are duplicated. The valves 145 and 147 of FIG. 2 are identical and differ only in function. Accordingly, a description of one will suffice for all of them. The reference numerals are generic and do not specifically describe any particular valve. Thus, the reference numerals 145 and 147 are specific, while the numerals above 300 are generic.

The numeral 300 identifies a particular detent protruding into the tubular member 132. The detent is in the form of a rounded push rod 301 where it protrudes into the passage. It is rounded and relatively short. It has a length which, when depressed by the passing enlargement 127, causes the rod 301 to move to the left of FIG. 6. Its movement is opposed by a coil spring 302. An inlet is provided at 303. The inlet delivers oil under pressure to a chamber 304. The chamber is exhausted by a passage 305 through the valve body 306. The body 306 incorporates a shoulder immediately around the inlet opening of the passage 305, and the rod 301 extends through the passage and is positioned immediately adjacent to the shoulder to support a large disklike member 307. The disk 307 is equipped with a seal means in one face which contacts against the shoulder to thereby serve as a face seal. When the rod 301 is to the right at the urging of the spring 302, a seal is maintained. As the pressure in the line 303 increases, the seal is all the more effective.

The passage 305 extends through the body 306 to an outlet tubing 308. The passage 308 is then input to a manifold 150 which is common to five of the valves. It will be observed that the detents of adjacent valves are spaced sufficiently far apart that only one is operated at a time, and, therefore, only one valve is communicated with the manifold 150 at any one time.

Attention is next directed to FIG. 2 of the drawings, where a sequence of operation will be described. The description will refer primarily to FIG. 2 of the drawings, although certain components are shown in other views. In any event, the pressure of the mud flow against the coil spring 20 compresses it. When it is compressed, the oil which is in the tubular member 23 is pumped to the bottom end and flows out through the passage 37 and into the line 50. The line 50 is connected to the reservoir 215 shown in FIG. 3G. This reservoir is a low pressure reservoir. It has a large supply of oil under minimum pressure for the equipment.

The line 136 (FIG. 3E) is input to one side of the piston 125 as shown in FIG. 2. In addition, the line 136 also connects to the topmost detent operated valve shown in FIG. 3E, this connection being a branch line 148 shown in FIG. 3E. This is the first or topmost of the several valves, and it is a fill valve. This valve is in FIG. 2 at 147. It is normally closed. It is not able to open until the detent for this valve is operated by movement of the enlargement 127 at the urging of the piston 125 shown in FIG. 2. When the enlargement 127 moves up, the fill valve 147 opens from its closed position and delivers oil through a check valve and outlet line 149 to fill all five of the transducers shown. The filling is not simultaneous; it is sequential. All of the transducers are identical in construction. Their construction is set forth in the top portions of FIG. 4. Each one is filled, introducing hydraulic oil through the top or end port as shown in FIG. 4. When the oil is introduced, the piston shown in FIG. 4 is driven downwardly. It travels for a distance, determined by the closure of the small piston in the large piston. The piston thus moves until the face seal ring closes, this contact being achieved between the two pistons and sealing the two pistons against the further introduction of oil. A specified volume of oil will fill each piston if the maximum is permitted, and a prorated portion will fill each transducer dependent on the measurement which it achieves. In FIGS. 3E and 2, the conduit 50 is shown connected to the pipe 136.

Continuing on with the operation of the apparatus shown in FIG. 2, each of the five transducers is filled. The filling is proportionate to the signal formed by each. In the illustrated construction, oil is trapped in each transducer and is held there. It is held there indefinitely. It remains there until the enlargement 127 strikes the detent for the particular valve which releases the particular transducer. As shown in FIG. 2, the enlargement 127 moves past the several transducer valves and strikes the detents one after another. The operation of one transducer valve is duplicated in all the others.

When a particular transducer valve is operated, its output flow is connected through the manifold 150 shown in FIG. 2. The line 150 is input at the top end of FIG. 5. The oil moves the piston 154 proportionate in time (not stroke) to the variable measurement. This movement is coupled through the valve apparatus shown in FIG. 5. It forms output signals in the conduits 185 and 200. These conduits extend downwardly through the equipment as shown in FIG. 3F, extending through the portion of the equipment shown in FIG. 3G and operate the piston 250 shown in FIG. 3H. That piston is slaved to the piston 154. It is extended downwardly by a specified stroke. It is held down for a duration dependent on the transducer oil capacity to encode the particular variable. This modulates the mud flow through the orifice 280. When the mud flow is modulated, a variation in flow rate and, hence, pressure is formed which can be detected at the surface later on.

The piston 250, being slave to the piston 154, returns to the up position of the drawings rapidly. This is achieved by the return of the piston 154 under high pressure hydraulic urging to return to the up position. The piston 154 is urged upwardly by a spring when it is in the quiescent state.

The piston 125 moves at a controlled rate so that the detents are stroked with sufficent time therebetween to enable the piston 250 to be fully actuated to the down or modulating position and to be returned to the up or withdrawn position. There is a lull between signals. The device utilizes five transducers and, therefore, forms five sequential output signals. Three are variable signals. Two are calibration signals. The calibration signals are achieved by utilizing the apparatus shown in the top portions of FIG. 4. Each transducer has a probe 74 which is permitted to extend by a length determined by a short, medium or long enclosure tube. This is better shown in FIGS. 3C and 3D, where the short calibration transducer has a relatively short extension cannister for receiving the probe, which length limits its travel. The transducer 121 enables a longer stroke in comparison with the scale of the transducer 118 shown in FIG. 3C.

Eventually, the enlargement 27 travels the full length of its travel. As shown in FIG. 3E, the last detent encountered is the dump valve at the very bottommost location. The dump valve is also connected to the line 136. The line 136 is a low pressure line. When the dump valve is opened, it dumps oil from the line 136 to a low pressure reservoir 215. When this occurs, pressure in the line 136 drops markedly, and the cap 14 drops below the constriction 14.

This is repeated in cyclical fashion. That is to say, the piston 125 is moved to the top end of its stroke and thereafter restroked. During its return, each transducer adjusts to a new value as exemplified by rotation of the magnet. This resets each transducer physically and thereby enables it to refill with a different quantity of oil. The cycle is repeated each time the pumps are stopped and restarted.

The foregoing description of operation is an accurate statement of the operation of the tool, but it is not complete in that it does not describe every movement. It is submitted that understanding is enhanced by breaking up the description into different descriptive segments of operation. With this in view, perhaps a good beginning point for the next descriptive sequence is to focus on the top end of the tool. It will be understood that the tool is used continuously to deliver mud as long as the mud pumps are operative at the well head. The mud flows through the drill string and through the measuring tool 10. It will be recalled that the upper end of the tool shown in FIG. 3A incorporates a choke 16 which constricts the passage within the heavy outer body 17. When the pumps are operative, the spring 20 is compressed as the cap 14 is forced downwardly below the constriction 16. This downward telescoping movement pressurizes the oil in the tool. The cap stays down indefinitely dependent on mud pressure. When the mud pressure is high, which is associated with continued operation, the cap 14 remains down. When the pumps are stopped for any reason whatsoever, the cap 14 will rise.

Typically, the mud pumps are stopped to add another joint of pipe. They might also be stopped to permit directional measurements to be made very intentionally. In any case, the fluid force holding the cap 14 below the constriction 16 terminates, and the spring 20 forces the cap upwardly. When this movement occurs, the chamber 23 is enlarged, reducing its internal pressure, and the lower sump 215 delivers oil under pressure. The drop of pressure is also sensed in the chamber 15 and the chamber 23.

The chamber 215 is communicated directly without restriction to the chamber 23. It is not communicated so directly with the chamber 15.

When the mud pump is stopped, the cap 14 is at its lowermost position. Simultaneously, in each of the transducers, the piston 67 is touching its closure plate 64, and the chamber 66 is reduced to zero volume. The piston 125 is in the down position (FIG. 3D), and it remains in the down position until the mud pump is stopped. When it is down, the enlargement 127 which is carried by it is adjacent to the detent of the dump valve, and it holds the dump valve open.

When the mud flow stops, the spring 20 forces the cap 14 upwardly, and oil pressure at the top end of the tool drops below the pressure in the sump 215. This drop depends on the force of the spring 20 and the area inscribed by the sliding seal 23. When this drop of pressure occurs, oil is first delivered through the line 136 through restrictors and underneath the piston 125. The piston is stroked upwardly. The rate of movement upward is controlled by the restrictors 137 and 140. The enlargement 127 is driven upwardly as oil is introduced beneath the piston 125. As it moves upwardly, it strokes each of the valves in sequence. As each valve is opened, oil flows from the lower chamber 215 through the control means 151. It additionally flows through the check valve 170 in the piston 157, up the line 150 through the detect operated, open valve and upward through a line 60. The small piston 72 is found touching the snap ring 73 at the beginning of operations, and the face seal on the upper face of the piston 72 is open to flow. Oil flows down through the tube 63 (see FIG. 4) into the passage 68, up through the annular cavity 69 and into the internal cavity 66 above the large piston 67. Oil delivered to the cavity 66 is at an increased pressure compared with the oil in the upper chamber 15 at this instant. The pressure differential forces the pistons 67 and 72 jointly downwardly toward the cam 79. When the probe 74 contacts the cam, the small piston 72 is stopped. The piston 67 continues its downward stroke at the urging of hydraulic pressure. This stroke continues until the face seal between the pistons 67 and 72 is contacted, closed and flow is interrupted to stop movement of the large piston 72. Needless to say, the valve 72 forbids flow in the opposite direction. This permits oil to escape the chamber of cylinder 66, not enter it.

After the pistons 67 and 72 have achieved a stationary position with sealing contact made, the enlargement 127 moves further up the tube and away from the detent. The particular transducer valve closes and thereby traps oil in the chamber 66. This oil is kept in the chamber until the enlargement 127 opens the detent operated valve again.

It will be recalled that the piston 125 is at the bottom end of the cylinder which contains it. As it strokes upwardly, the enlargement 127 operates the detent operated valves, and a variable quantity of oil is introduced into the transducers. The piston 125 travels to the top of its stroke to bring the enlargement 127 into contact with the detent for the fill valve. The fill valve permits communication with the sump 215 to the top of the tool. Oil then flows from the sump 215 without restriction until full extension of the cap 14 is achieved by locking contact with the shoulders 21.

At this time, the mud flow has been stopped while the measurements are made by the transducers. Each measurement is expressed by a quantity of oil in the chamber 66 of the various transducers. The components of the tool achieve the positions shown in FIG. 3. They may hold this position for a short or long interval dependent on how long the mud pumps are stopped. When the mud pumps are restarted, mud flows past the cap 14 and is constricted by the ring 16. This creates hydraulic pressure acting on the cap 14. As the mud pressure increases, the pressure within the upper end of the tool increases. It serves as the power source for energy to take the tool through the sequence of operations whereby signals are transmitted to the surface. This increase in pressure acts on the chamber 23 to compress the spring 20 and force the chamber downwardly. After this occurs, the cap 14 in the attached tubular body also descends.

It will be recalled that the upper chamber is filled through the fill valve 147. A check valve prevents downward flow through it. The upper chamber 15 is in fluid communication with all the voids in the chambers in the upper end of the tool 10. Thus, it is coextensive with the chambers 48 and 122. The piston 125 travels upwardly against a snap ring, and, therefore, the piston 125 is exposed in the chamber 122 to chamber pressure. Movement of the cap 14 thus compresses the oil, increases its pressure and acts directly on top of the piston 125. The oil in the cylinder 124 below the piston 125 is forced out of the cylinder 124 through the choke 137. The choke delivers oil into the sump 215. The choke 137 controls the rate at which the piston 125 moves downwardly. Its downward stroke is accompanied by movement of the enlargement 127 which opens each of the valves assigned to the various transducers in sequence. When each valve is opened, the oil in the chamber 66 where the particular transducer is forced through the check valve 71 and into a line 60 by the oil surrounding the transducer and acting on the bottom side of the pistons 67 and 72. The oil captured in the chamber 66 passes through the open valve, the line 150, the control valve 151, the choke 169 and then into the sump 215. As the oil flows through the choke 169, there is a pressure drop across the coke which forces the piston 157 to compress the spring 159. The piston 157 seats on the shoulder 160. No oil flows through the check valve 170 at this moment because it permits flow only from the passage 172 to the line 150, and not in the reverse direction. As the piston 157 moves down to the shoulder 160, the seals 166 and 191 close, while the seals 190 and 206 open. This permits oil under pressure to be routed into the mechanism 151 through the port 186. The port 186 opens through the seal 190 to the line 185, the oil flows to the top of the piston 250. This drives the piston 250 down. Oil from under the piston 250 moves up through the passage 218 and the line 200. The line 200 returns to the control means 151 through the open seal 206 and into the line 203. It finally terminates in the sump 215.

Downward movement of the piston 250 is accompanied by movement of the plunger 283 which moves into the bore or passage 280. This restricts the flow of mud, but it does not completely stop mud flow. The restriction is sufficient to create a chamber pulse which travels up to the surface through the mud column flowing in the drill string. This is a back pressure surge at the surface. The duration of the signal is related to the magnitude of the measured variable.

Referring to each transducer, oil in the chamber 66 is pumped out as the piston 67 moves upwardly to the top closure plate 64. When this happens, the spring 159 forces the piston 157 upwardly against the plug 154. This forces a small volume of oil between the piston 157 and the plug 154 to the choke 169. This causes the seals 166 and 191 to open. Conversely, the seals 190 and 206 close. The oil, under elevated pressure entering the port 186, is flowed through the line 200 to the chamber below the piston 250, and oil above the piston is removed therefrom to the sump 215. The piston 250 is positively driven upwardly by the power supplied below it, and the plunger 283 is retracted from the constricted bore 280. This ends the pressure pulse. The bore or constricted passage 280 then delivers full flow of mud.

Thereafter, the enlargement 127 moves away from the transducer control valve which closes and hydraulically locks the piston 67 at the top end of its stroke against the closure member 64. The chamber 66 is reduced to its minimum capacity.

The enlargement 127 has a continued downstroke until it opens the dump valve at the bottom end of the stroke. The dump valve was theretofore closed. Oil under pressure from the top end of the tool is dumped through the dump valve to the sump 215. The cap 14 is then permitted to drop below the constriction 16. At this time, the cap 14 might be elevated above the constriction as it continues its downstroke. Because it is hydraulically driven in its downward movement, the beginning point at full extension which results in movement toward the constriction 16 serves as a pump providing oil under elevated pressure. The opening of the dump valve drops the pressure in the chamber at the top end of the tool, relieves the oil in it and fills the sump 215. The pressure in the upper end of the tool is then equalized with the pressure in the lower end of the tool, while the spring 261 holds the piston 250 and its associated plunger 283 in the up position to avoid creating meaningless pressure pulses.

The full operation of the tool is understood from the foregoing.

Figure 7:
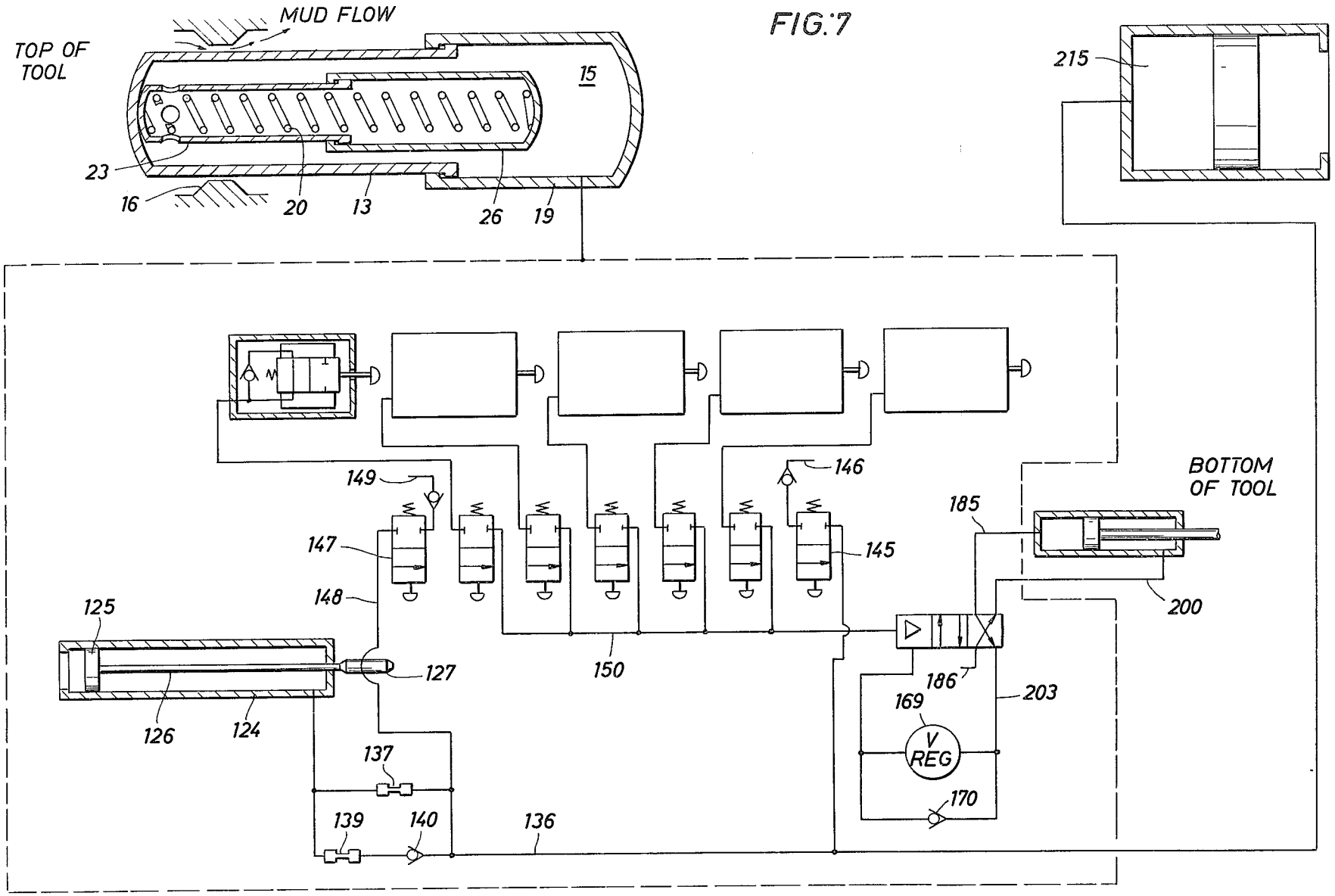
FIG. 7 is an alternative construction to that of FIG. 2.

Attention is next directed to FIG. 7 of the drawings, which is an alternate construction to FIG. 2. The points of similarity do not require significant description. The points of differences are relatively straightforward. The modifications result in a simpler construction.

The duration of a pressure pulse is indicated by oil flow through the choke 169 and the pressure drop across this coke. This pressure drop is approximately equal to the pressure difference between the oil in the sump and the elevated pressure of oil at the upper end of the tool. In order to maintain the pressure drop constant during each cycle of measurement, the spring 20 was incorporated in the chamber 23 which was dumped to the sump 215. This act of dumping accompanied compression of the spring 20. Consequently, the compressed spring 20 had no subsequent effect on pressure of the oil in the elevated system. With this in view, the constriction 169 is converted from a choke 169 to a flow control valve. Flow control valves are readily available which provide constant flow even though the pressure drop across the valve may vary. By incorporating this, it eliminates the need for isolating the influence of the spring 20. The spring chamber 23 can then be eliminated. This can be easily accomplished by simply putting a port in the chamber 23. If this is done, the line 50 is then eliminated. Elimination of the line 50 still permits oil to flow from the top chamber 15 to the chamber 122, which is the void area in the tool itself. The structure of FIG. 7 remains the same in other regards.

The foregoing is directed to the preferred embodiment of the present invention, but the scope is determined by the claims which follow.

I claim:

1. A device for forming a mud flow modulated signal installable in a drill string, the device comprising:

(a) An elongate, hollow, outer body adapted to be connected in a drill string;

(b) An elongate, tubular inner body received within said outer body;

(c) Means positioning said inner body in said outer body to form an annular space between said inner body and outer body directing mud flow through said annular space;

(d) A closed, hydraulic reservoir in said inner body and exposed to the mud flow through said annular space;

(e) Pressure responsive means connected to said closed, hydraulic reservoir for limiting the pressure of hydraulic fluid placed in said reservoir.

(f) Hydraulic fluid line means extending from said reservoir for delivering hydraulic fluid under pressure;

(g) A piston in a cylinder;

(h) Constriction means in said annular space which directs the mud flow therethrough which constriction means is located in said outer body and which further directs the mud flow downwardly through said outer body;

(i) Plug means extending into said constriction means for varying the mud flow permitted through said constriction means, said plug means being movable by said piston relative to said constriction means;

(j) Control valve means connected to said piston and cylinder for controllably delivering hydraulic fluid thereto from said hydraulic line means for controllably moving said piston in said cylinder;

(k) Transducer means adapted to respond to a variable of interest and which transducer means receives hydraulic fluid and encodes the variable in a fluid quantity at least partially dependent on the variable of said transducer means;

(l) Value means associated with said transducer means for delivering fluid from said transducer means to said control valve means to controllably open said control valve; and (m) means for periodically supplying said transducer means with hydraulic fluid.

2. The apparatus of claim 1 including a spring means and a pressure opposing piston in said closed, hydraulic reservoir.

3. The apparatus of claim 1 including a second transducer means for measuring a second variable of interest and which operates similar to said first transducer means.

4. The apparatus of claim 3 including means for multiplexing said valve means associated with said transducer means to selectively provide a signal for said control valve means first from one of said transducer means and thereafter from the other of said transducer means.

5. The apparatus of claim 4 wherein said multiplexer means includes a piston having a rod connected thereto which rod selectively opens and closes individual multiplex valves connected with each of said transducer means wherein said multiplex valves are sufficiently spaced apart from one another such that they are individually stroked to open and close in nonoverlapping operation.

6. The apparatus of claim 5 wherein said piston rod is controllably driven by hydraulic fluid delivered thereto through a control choke which controls the rate of actuation.

7. The apparatus of claim 1 wherein said transducer means incorporates a piston in a cylinder which piston moves as hydraulic fluid is introduced on one side of said piston and which piston is physically blocked from subsequent movement, the range of movement indicating the variable sensed by said transducer means.

8. The apparatus of claim 7 wherein said piston is moved in response to hydraulic fluid introduced on one side thereof and further including a control piston with a face valve cooperative between said control piston and said piston to limit travel thereof.

9. The apparatus of claim 7 including a protruding probe moved by said piston means which probe protrudes by an amount permitted by a cooperative variable encoding means.

10. The apparatus of claim 9 wherein said probe protrudes against a profiled surface forming an indication of the angle of inclination of the tool.

11. The apparatus of claim 9 wherein said probe protrudes against a helix mounted on a drum wherein said drum is rotated to encode drum rotation into the movement of said probe.

12. The apparatus of claim 9 wherein said probe protrudes against a pendulum and the range of movement thereof is determined by the position of said pendulum.

13. A device for forming a mud pressure pulse signal which device is adapted to be installed in a drill string, the device comprising:

(a) an elongate, hollow, outer body adapted to be connected in a drill string;
(b) an elongate, tubular, inner body received within said outer body;
(c) means positioning said inner body in said outer body to form an annular space between said inner body and said outer body directing mud flow through said annular space;
(d) a closed, hydraulic reservoir in said inner body;
(e) means for pressurizing hydraulic fluid in the hydraulic reservoir;
(f) output means which means is hydraulically operated for forming a mud pressure pulse signal when operated;
(g) constant pressure regulator means connected to said reservoir for acting on the fluid therein to thereby regulate and control the pressure of the fluid between limits in said reservoir for operation of said output means.

14. The apparatus of claim 13 wherein said constant pressure regulator means comprises a spring return and a mud driven means which acts on hydraulic fluid to provide pressure thereto.

15. The apparatus of claim 13 wherein said constant pressure regulator means includes a choke means for controlling the flow of hydraulic fluid from said reservoir to thereby deliver the flow at a regulated rate.

16. In a measuring while drilling device adapted to be installed in a drill string to encode downhole variables for providing well head information, the device comprising:

(a) an elongate, hollow, outer body adapted to be connected in a drill string;
(b) an elongate, enclosed, instrument package carrying instrumentation therein and supported by said outer body;
(c) a closed, hydraulic reservoir in said inner body;
(d) means for applying pressure to hydraulic fluid in said hydraulic reservoir;
(e) at least a pair of variable transducer means carried by said instrument package wherein each of the pairs encodes a given variable and the encoding is achieved by filling with hydraulic fluid in volume related to the measurement of said transducer means;
(f) transducer outlet valve means associated with each of said transducer means for receiving the hydraulic fluid in said transducer means;
(g) an output means for forming a mud pressure pulse signal; and
(h) multiplexer means for selecting in multiplexed fashion said outlet valve means associated with said transducer means for operation of said output means so that said transducer means periodically form mud pressure pulse signals.

17. In a measuring while drilling tool which is adapted to be installed in a drill string, an apparatus which comprises:

(a) an elongate, hollow, outer body adapted to be connected in a drill string;
(b) an elongate, enclosed, instrument package carrying instrumentation therein and supported by said outer body;
(c) a closed, hydraulic reservoir in said inner body;
(d) at least a pair of transducer means which encode downhole variables wherein the encoding is achieved by delivering a quantity of hydraulic fluid where the quantity is varied in relation to the variable measurement obtained by said transducer means;
(e) an output means for forming a mud pressure pulse signal;
(f) means for preparing said transducer means for operation by delivering hydraulic fluid thereto wherein said transducer means receives a portion of hydraulic fluid which is determined by the variable measurement to be encoded; and
(g) means for hydraulically operating said output means in proportion to the hydraulic fluid received from said transducer means where said transducer means are periodically operated to provide the hydraulic fluid therein as a means of encoding the variable measured thereby.

18. The apparatus of claim 17 wherein said transducer means are filled to the extent permitted with hydraulic fluid and any excess provided thereby is returned to said hydraulic reservoir.

19. The apparatus of claim 17 wherein said apparatus includes a hydraulically powered, two-position, four-way valve in said output means which valve positions a constrictive means in the mud flow through the drilling string.

20. In a measuring while drilling apparatus which is adapted to be installed in a drill string, the improvement which comprises:

(a) an elongate, hollow, outer body adapted to be connected in a drill string;

(b) an elongate, enclosed, instrument package carrying instrumentation therein and supported by said outer body;

(c) a closed, hydraulic reservoir in said inner body;

(d) a first variable transducer means which encodes a variable to be measured by forming a mechanical output;

(e) output means carried by said outer body for forming a mud pressure pulse signal in the drill string to be sensed at the well head which encodes variables input thereto; and (f) calibration means for operating said output means for specified calibration measurements so as to define measurements in the mud pressure pulse signals in the drill string from said output means for contrast with signals formed by said output means from said transducer means.

21. The apparatus of claim 20 wherein the minimum value of the transducer means is encoded by a short calibration signal, and the maximum value from said transducer means is encoded by a pulse from said output means which is maximum in length in comparison with the short calibration pulse.

22. The apparatus of claim 20 wherein said output means includes selectively operable constriction means for momentarily obstructing and thereby restricting flow through the drill string to form a mud pressure pulse signal in the drill string.

23. The apparatus of claim 20 including second and third transducer means to encode second and third variables.

24. In a measuring while drilling apparatus which is adapted to be installed in a drill string, the improvement comprising:

(a) a closed hydraulic reservoir in said apparatus for receiving and holding hydraulic fluid.

(b) at least two transducer means for measuring a variable which variable is encoded by altering a volume in said transducer means for receiving hydraulic fluid;

(c) means for filling said transducer means to a level related to and varied by the variable to be measured by said transducer means;

(d) output means affixed to said apparatus for forming a mud pressure pulse signal in the drill string; and (e) multiplexer means for selectively in timed fashion operating said transducer means for removing hydraulic fluid therefrom which hydraulic fluid is then conveyed to said output means which is hydraulically operated to form a mud pressure pulse signal in the drill string.

25. The apparatus of claim 24 wherein said transducer means includes a cam means which encodes the compass position of the apparatus and has a range of up to 360°.

26. The apparatus of claim 24 including pendulum means operatively connected to said transducer means for encoding the angular position of the apparatus relative to the vertical so as to encode the centerline angle of the apparatus relative to the vertical.

27. The apparatus of claim 24 including means which references the position of the apparatus in the drill string to a fixed location therein and which encodes that position while the drill string is angularly oriented in the hole.

28. In a measuring while drilling apparatus adapted to be installed in a drill string, the improvement which comprises:

(a) a closed, hydraulic reservoir for holding hydraulic fluid under pressure;

(b) transducer means for encoding a variable and which transducer means is operated by encoding the variable in a volume of hydraulic fluid which is at least in part dependent on the measure of the variable;

(c) piston means which travels in a guide means through a stroke of specified length;

(d) means for moving said piston at a specified rate along said guide means;

(e) spaced operator means along said guide means which are selectively tripped and operated by movement of said position means in said guide means, said operator means being constructed and arranged to enable operation of said transducer means;

(f) output means in said apparatus for forming a mud pressure pulse signal in the drill string; and (g) means connected to said transducer means for controlling said output means in a time-dependent fashion related to the hydraulic fluid from said transducer means so as to encode the variables of said transducer means in the drill string.

29. A device for forming a mud pressure pulse signal which device is adapted to be installed in a drill string, the device comprising:

(a) an elongate, hollow, outer body adapted to be connected in a drill string;

(b) an elongate, tubular, inner body received within said outer body;

(c) means positioning said inner body in said outer body to form an annular space between said inner body and said outer body for directing mud flow through said annular space;

(d) a closed, hydraulic reservoir in said inner body;

(e) means for pressurizing hydraulic fluid in the hydraulic reservoir;

(f) output means which means is hydraulically operated for forming a mud pressure pulse signal when operated;

(g) constant flow regulator means connected to said reservoir for acting on the fluid therein to thereby regulate and control the flow between limits of the fluid in said reservoir for operation of said output means.

30. The apparatus of claim 13 including at least two transducer means which encode variables sensed by said transducer means in the form of variable quantities of hydraulic fluid from said hydraulic reservoir wherein a hydraulic circuit conducts the quantity of hydraulic fluid to said output means for controlling said output means in operation for a duration determined by the quantity of fluid and which operation is accomplished at a pressure determined by said constant pressure regulator means.

31. The apparatus of claim 29 including at least two transducer means which encode variables sensed by said transducer means in the form of variable quantities of hydraulic fluid from said hydraulic reservoir wherein a hydraulic circuit conducts the quantity of hydraulic fluid to said output means for controlling said output means in operation for a duration determined by the quantity of fluid and which operation is accomplished at a flow rate determined by said constant flow regulator means.

32. The apparatus of claim 16 including a hydraulic circuit connected to said variable transducer means for receiving hydraulic fluid therefrom in volume related to the measurement determined by said transducer means, said circuit extending from said transducer outlet valve means through said multiplexer means and wherein said hydraulic circuit flows hydraulic fluid from said hydraulic reservoir and said circuit includes means for dumping flow of hydraulic fluid back to said reservoir in excess of the requirements for operation of said variable transducer means.

33. The apparatus of claim 17 including multiplexer means interposed between said transducer means and said output means for selecting one of said transducer means to operate said output means by delivering hydraulic fluid from said transducer means therethrough.

34. The apparatus of claim 20 including multiplexer means operatively connected between said first variable transducer means and said calibration means for selectively and controllably operating said output means to form the variable from said first variable transducer means and for forming a specified calibration measurement from said calibration means.

* * * * *